US009405225B2

(12) United States Patent
Matsushita et al.

(10) Patent No.: US 9,405,225 B2
(45) Date of Patent: Aug. 2, 2016

(54) DEVELOPER ACCOMMODATING UNIT, PROCESS CARTRIDGE AND IMAGE FORMING APPARATUS

(71) Applicant: CANON KABUSHIKI KAISHA, Tokyo (JP)

(72) Inventors: Masaaki Matsushita, Yokohama (JP); Tatsuo Fujisaki, Yokohama (JP); Junichi Matsumura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/149,194

(22) Filed: Jan. 7, 2014

(65) Prior Publication Data

US 2014/0199092 A1 Jul. 17, 2014

(30) Foreign Application Priority Data

Jan. 11, 2013 (JP) ..... 2013-003261

(51) Int. Cl.
*G03G 15/08* (2006.01)

(52) U.S. Cl.
CPC ..... *G03G 15/0882* (2013.01); *G03G 15/0841* (2013.01); *G03G 15/0868* (2013.01); *G03G 15/0874* (2013.01); *G03G 15/0875* (2013.01); *G03G 15/0898* (2013.01);
(Continued)

(58) Field of Classification Search
CPC ..... G03G 15/0841; G03G 15/0874; G03G 15/0868; G03G 21/1674; G03G 2215/0682; G03G 2215/0687; G03G 2215/0875; G03G 15/0875; G03G 15/0882
USPC ..... 399/103, 106, 119, 120, 258
See application file for complete search history.

(56) References Cited

U.S. PATENT DOCUMENTS 5,030,998 A * 7/1991 Shibata et al. ..... 399/106
5,264,901 A * 11/1993 Rossiter ..... G03G 15/0894 222/DIG. 1
2007/0104505 A1 5/2007 Murakami et al.
(Continued)

FOREIGN PATENT DOCUMENTS

CN 1963687 A 5/2007
CN 101286035 A 10/2008
(Continued)

OTHER PUBLICATIONS

Office Action in Chinese Patent Application 201410012198.5, dated Apr. 6, 2016 (with English translation).

*Primary Examiner* — Ryan Walsh
(74) *Attorney, Agent, or Firm* — Fitzpatrick, Cella, Harper & Scinto

(57) ABSTRACT

A developer accommodating unit for accommodating a developer includes: a flexible container provided with an opening for permitting discharge of the accommodated developer; a sealing member for sealing the opening and for exposing the opening by being moved in a direction crossing a longitudinal direction of the developer accommodating unit; an unsealing member, mounted to the sealing member, for moving the sealing member; a frame including a fixing portion for fixing the flexible container; and a bonding portion for bonding an end portion of the sealing member and a periphery of the opening. The bonding portion includes a projected portion or recessed portion in a plane of the bonding portion as at least a part thereof, in an upstream side or a downstream side of the opening with respect to an unsealing direction of the opening.

45 Claims, 18 Drawing Sheets

(52) U.S. Cl.
CPC ..... *G03G 2215/0682* (2013.01); *G03G 2215/0687* (2013.01); *G03G 2215/0875* (2013.01)

(56) References Cited

U.S. PATENT DOCUMENTS

| | | | |
|---|---|---|---|
| 2008/0253803 | A1 | 10/2008 | Nittani et al. |
| 2011/0020031 | A1 | 1/2011 | Sato et al. |
| 2011/0170906 | A1 | 7/2011 | Matsushita et al. |
| 2012/0177406 | A1 | 7/2012 | Suzuki et al. |
| 2013/0136489 | A1 | 5/2013 | Yamaguchi et al. |
| 2013/0164039 | A1 | 6/2013 | Matsushita et al. |
| 2013/0164040 | A1 | 6/2013 | Matsushita et al. |
| 2013/0336679 | A1 | 12/2013 | Furutani et al. |
| 2013/0343785 | A1 | 12/2013 | Matsuzaki et al. |
| 2014/0016961 | A1 | 1/2014 | Yasui et al. |
| 2014/0029974 | A1 | 1/2014 | Uesugi et al. |
| 2014/0064793 | A1 | 3/2014 | Matsuzaki et al. |
| 2014/0072331 | A1 | 3/2014 | Matsushita et al. |
| 2014/0072345 | A1 | 3/2014 | Matsunaga et al. |
| 2014/0072347 | A1 | 3/2014 | Furutani et al. |
| 2014/0079432 | A1 | 3/2014 | Matsuzaki et al. |
| 2014/0126928 | A1 | 5/2014 | Batori et al. |
| 2014/0199093 | A1 | 7/2014 | Yoshida et al. |
| 2014/0199094 | A1 | 7/2014 | Matsuzaki et al. |
| 2014/0199096 | A1 | 7/2014 | Yoshida et al. |

FOREIGN PATENT DOCUMENTS

| | | |
|---|---|---|
| CN | 102591183 A | 7/2012 |
| JP | H 4-66980 | 3/1992 |
| JP | H 7-209976 | 8/1995 |

* cited by examiner

DEVELOPER ACCOMMODATING UNIT, PROCESS CARTRIDGE AND IMAGE FORMING APPARATUS

FIELD OF THE INVENTION AND RELATED ART

The present invention relates to a developer accommodating unit, a process cartridge and an image forming apparatus including these members.

As an electrophotographic image forming apparatus for forming an image on a recording material (medium) by using an electrophotographic image forming process, there is, e.g., an electrophotographic copying machine. Further, the electrophotographic image forming apparatus includes, e.g., an electrophotographic printer such as LED (light emitting diode printer or laser beam printer; an electrophotographic facsimile machine; an electrophotographic word processor; and the like.

Further, the process cartridge refers to a cartridge which is prepared by integrally assembling at least a developing means and a developer accommodating unit accommodating a developer into a unit (cartridge) and which is made detachably mountable to an electrophotographic image forming apparatus main assembly.

Further, a developer accommodating container and the developer accommodating unit are to be accommodated in the image forming apparatus or the cartridge. Each of the developer accommodating container and the developer accommodating unit includes at least a flexible container for accommodating the developer.

In a conventional electrophotographic image forming apparatus using the electrophotographic image forming process, a process cartridge type in which an electrophotographic photosensitive member and image forming process means actable thereon are integrally assembled into a cartridge and the cartridge is made detachably mountable to the electrophotographic image forming apparatus main assembly has been employed.

In such a process cartridge, as shown in FIG. 18, an opening provided in a developer accommodating frame 31 for accommodating the developer (toner, carrier and the like) is sealed with a sealing member 32. In order to reduce a load of a user when the user pulls and peels out a bonding portion 33 formed by (thermal) welding, a constitution in which a free end of the sealing member 32 is folded back and the user can pull the sealing member 32 in an opposite direction (arrow direction in FIG. 18) to a fold back portion haw been widely used. A process cartridge in which a welding pattern is devised for alleviating a force for pulling the sealing member 32 to improve an unsealing operativity has been provided by Japanese Laid-Open Patent Application (JP-A) Hei 07-209976.

In this process cartridge, a leading end portion 36*a* and a trailing end portion 36*b* of the sealing member 32 with respect to a pulling-out direction are formed in a mountain (V-character) shape. Further, a seal width of each of the leading end portion 36*a* and the trailing end portion 36*b* is made narrower than the seal width of an intermediate portion (central portion). As a result, strength when the user pulls and unseals the sealing member 32 in the case where an opening width is broad.

Further, in order to solve a problem such that the developer is scattered in the process cartridge in a developer filling step during manufacturing of the process cartridge, a process cartridge using deformable inside container has been proposed in JP-A Hei 04-066980.

However, there was the following problem in the convention process cartridge.

For the purpose of reducing a cost of a developer supplying device by improving operativity of supply of the developer and by preventing the scattering of the developer in the process cartridge, a method of accommodating the developer in a deformable developer accommodating member has been described in JP-A Hei 04-066980. However, in the case where the developer is accommodated in the deformable developer accommodating member described in JP-A Hei 04-066980, during unsealing, an opening of the deformable developer accommodating member is pulled together with a toner seal to be largely deformed, so that it is difficult to effect the unsealing.

Further, a method in which the welding pattern of the sealing member is devised has been described in JP-A Hei 07-209976. As shown in FIG. 18, the leading end portion 36*a* and the trailing end portion 36*b* of the sheet-like sealing member 32 with respect to the pulling direction are formed in the mountain shape. As a result, a peeling force can be reduced to some extent. In order to further reduce the peeling force, an apex angle of the mountain shape of each of the leading end portion 36*a* and the trailing end portion 36*b* is required to be an acute angle smaller than 90 degrees. In that case, the mountain shape of each of the leading end portion 36*a* and the trailing end portion 36*b* is increased in size. With this increase in size of the mountain shape, there is a need to ensure a space for permitting sealing of the sheet-like sealing member 32 correspondingly, so that a toner accommodating device is increased in size.

SUMMARY OF THE INVENTION

A principal object of the present invention is to provide a developer accommodating unit, using a flexible container for accommodating a developer, capable of facilitating unsealing of a sealing member for sealing an opening of a flexible container.

According to an aspect of the present invention, there is provided a developer accommodating unit for accommodating a developer, comprising: a flexible container provided with an opening for permitting discharge of the accommodated developer; a sealing member for sealing the opening and for exposing the opening by being moved in a direction crossing a longitudinal direction of the developer accommodating unit; an unsealing member, mounted to the sealing member, for moving the sealing member; a frame including a fixing portion for fixing the flexible container; and a bonding portion for bonding an end portion of the sealing member and a periphery of the opening, wherein the bonding portion includes a projected portion or recessed portion in a plane of the bonding portion as at least a part thereof, in an upstream side or a downstream side of the opening with respect to an unsealing direction of the opening.

According to another aspect of the present invention, there is provided a developer accommodating unit for accommodating a developer, comprising: a flexible container provided with a plurality of openings for permitting discharge of the accommodated developer; a sealing member for sealing the openings and for exposing the openings by being moved; an unsealing member, mounted to the sealing member, for moving the sealing member; a frame including a fixing portion for fixing the flexible container; and a bonding portion for bonding an end portion of the sealing member and a periphery of the opening, wherein the bonding portion includes a projected portion or recessed portion in a plane of the bonding portion as at least a part thereof in an upstream side or a downstream side of the openings with respect to an unsealing direction of the openings.

These and other objects, features and advantages of the present invention will become more apparent upon a consideration of the following description of the preferred embodiments of the present invention taken in conjunction with the accompanying drawings.

Figure 4:
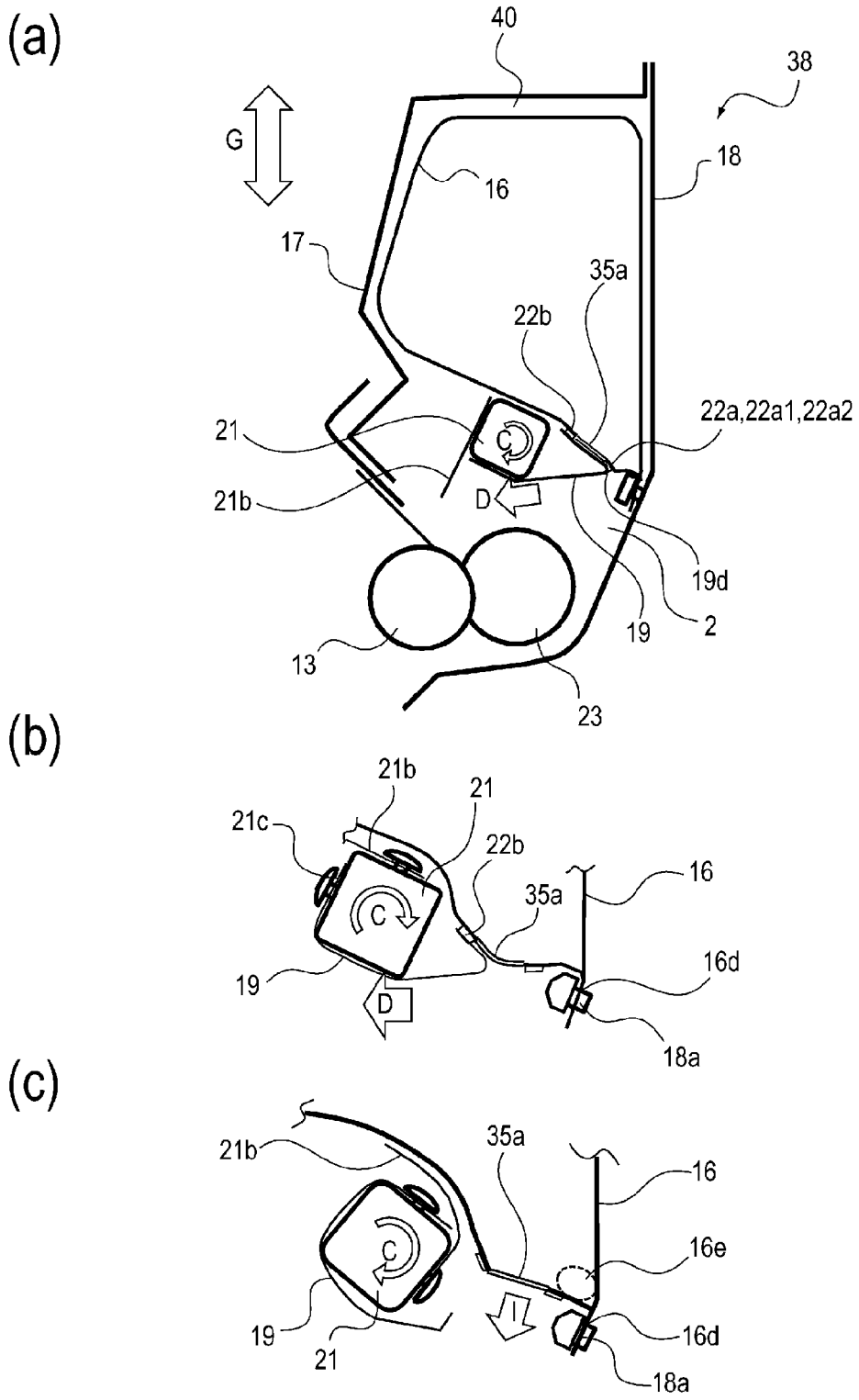

Part (a) of FIG. 4 is a sectional illustration showing a structure of a developing device in the developer accommodating unit, and (b) and (c) of FIG. 4 are sectional illustrations showing a state in which a bonding portion between a sealing member and the flexible container is peeled with advance of rotation of an unsealing member to expose an opening.

Figure 5:
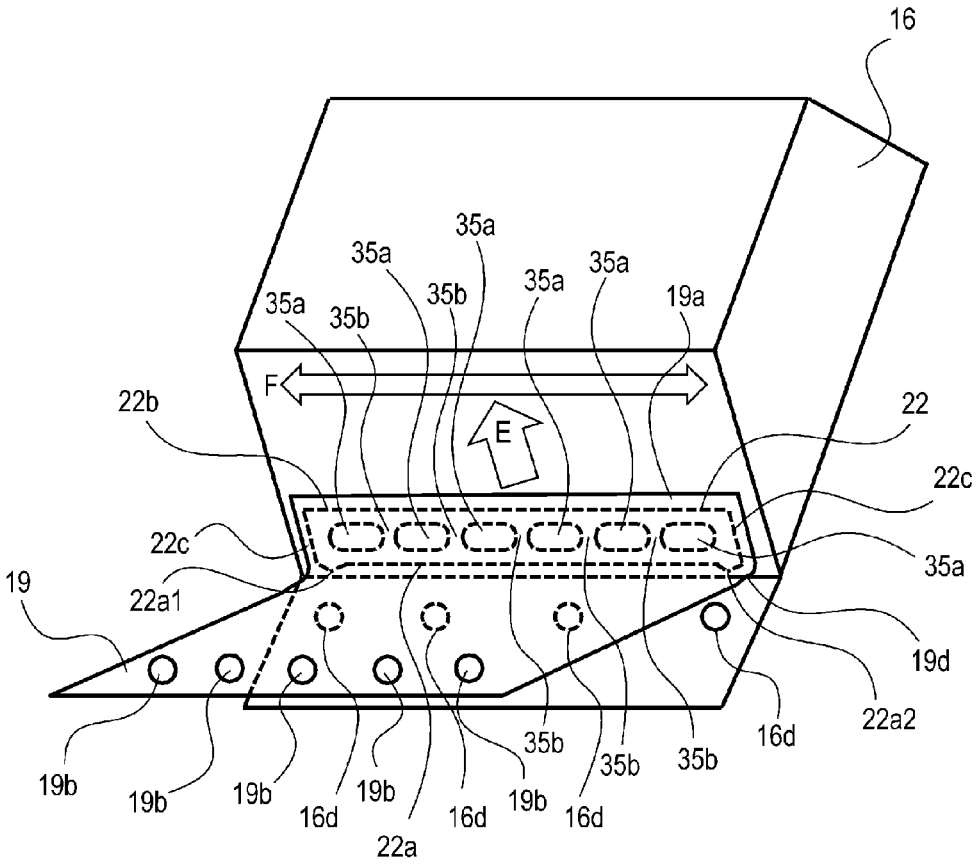

FIG. 5 is a perspective illustration showing a structure of the flexible container of the developer accommodating unit in Embodiment 1.

Figure 6:
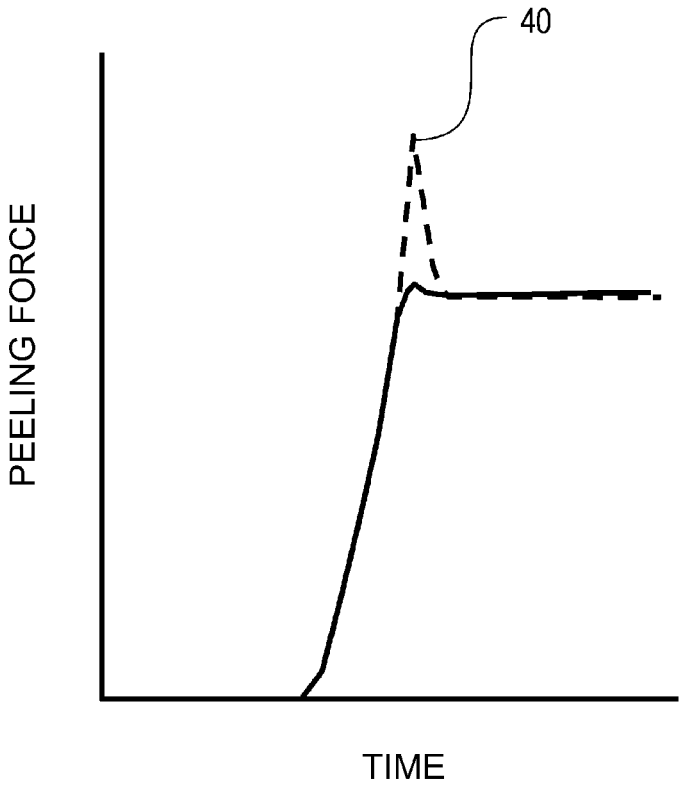

FIG. 6 is a graph for illustrating a peeling force when the flexible container of the developer accommodating unit in Embodiment 1 is unsealed.

Figure 7:
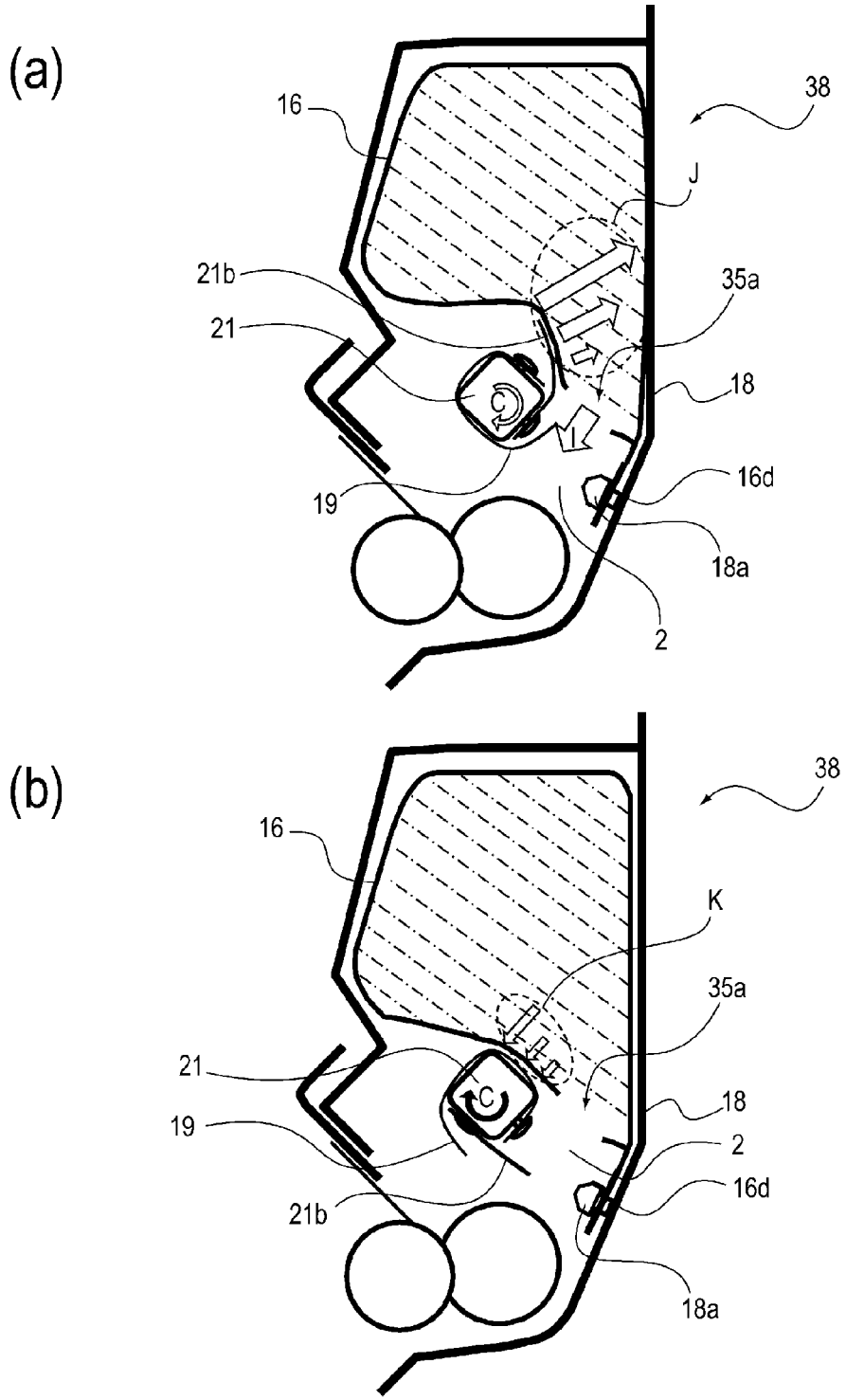

Parts (a) and (b) of FIG. 7 are sectional illustrations showing a structure of the developing device of the developer accommodating unit in Embodiment 1.

Figure 8:
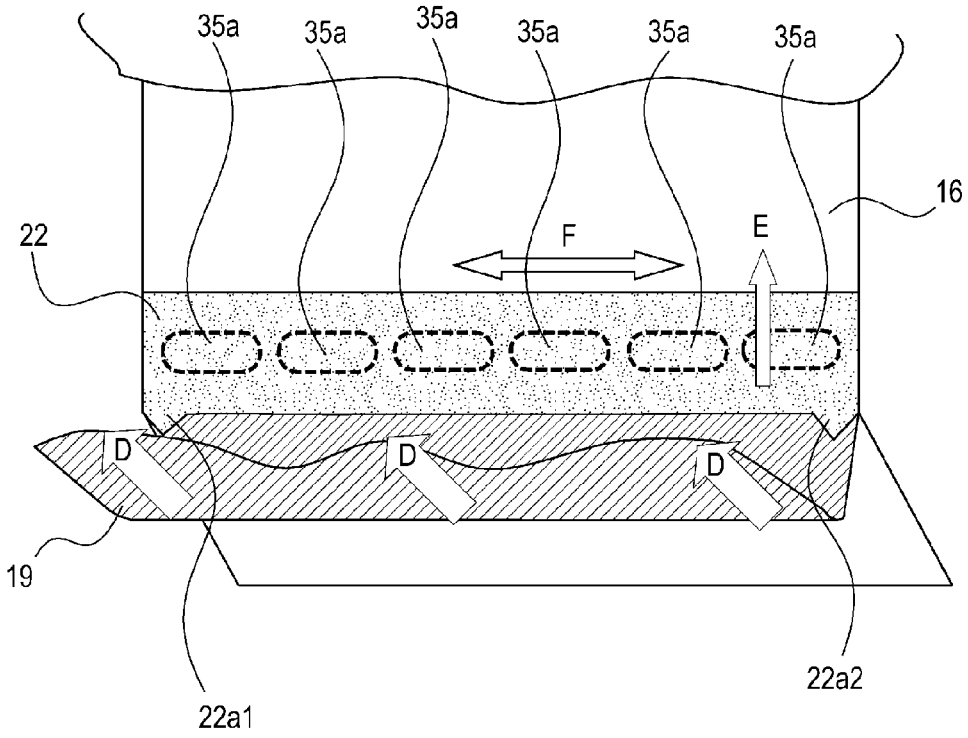

FIG. 8 is a perspective illustration showing another structure, in which a whole surface of the bonding portion is welded, of the developer accommodating unit in Embodiment 1.

Figure 9:
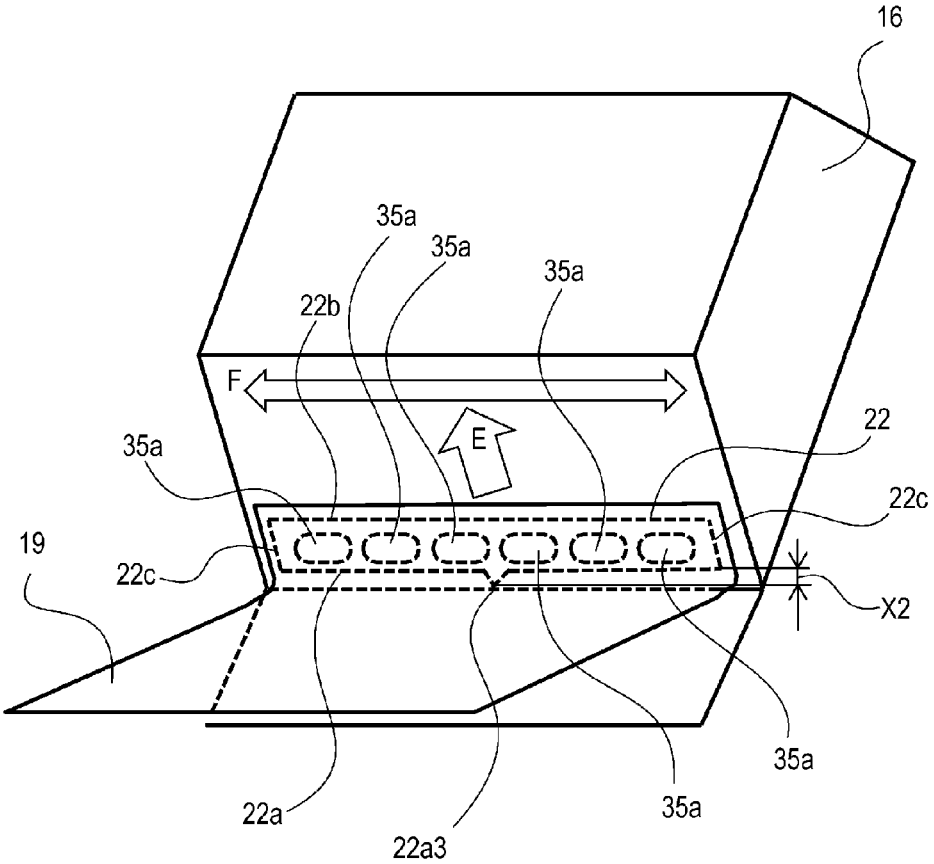

FIG. 9 is a perspective illustration showing a still another structure, in which the bonding portion is modified, of the developer accommodating unit in Embodiment 1.

Figure 10:
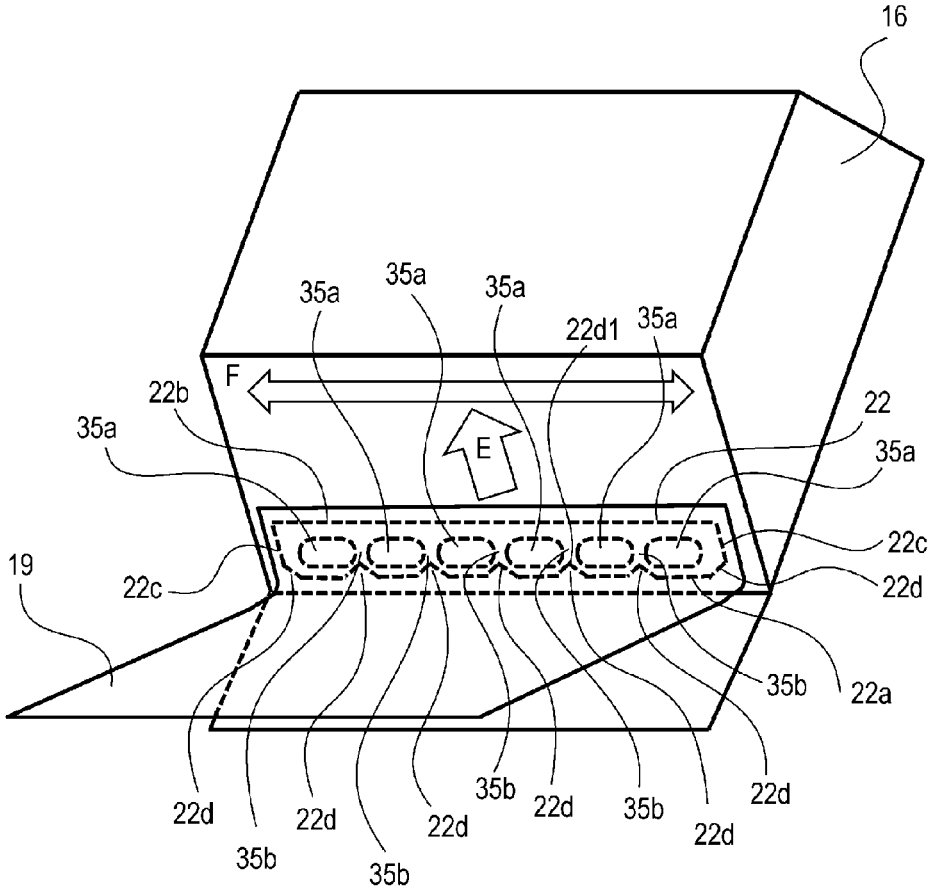

FIG. 10 is a perspective illustration showing a structure of a flexible container of a developer accommodating unit in Embodiment 2 of the present invention.

Figure 11:
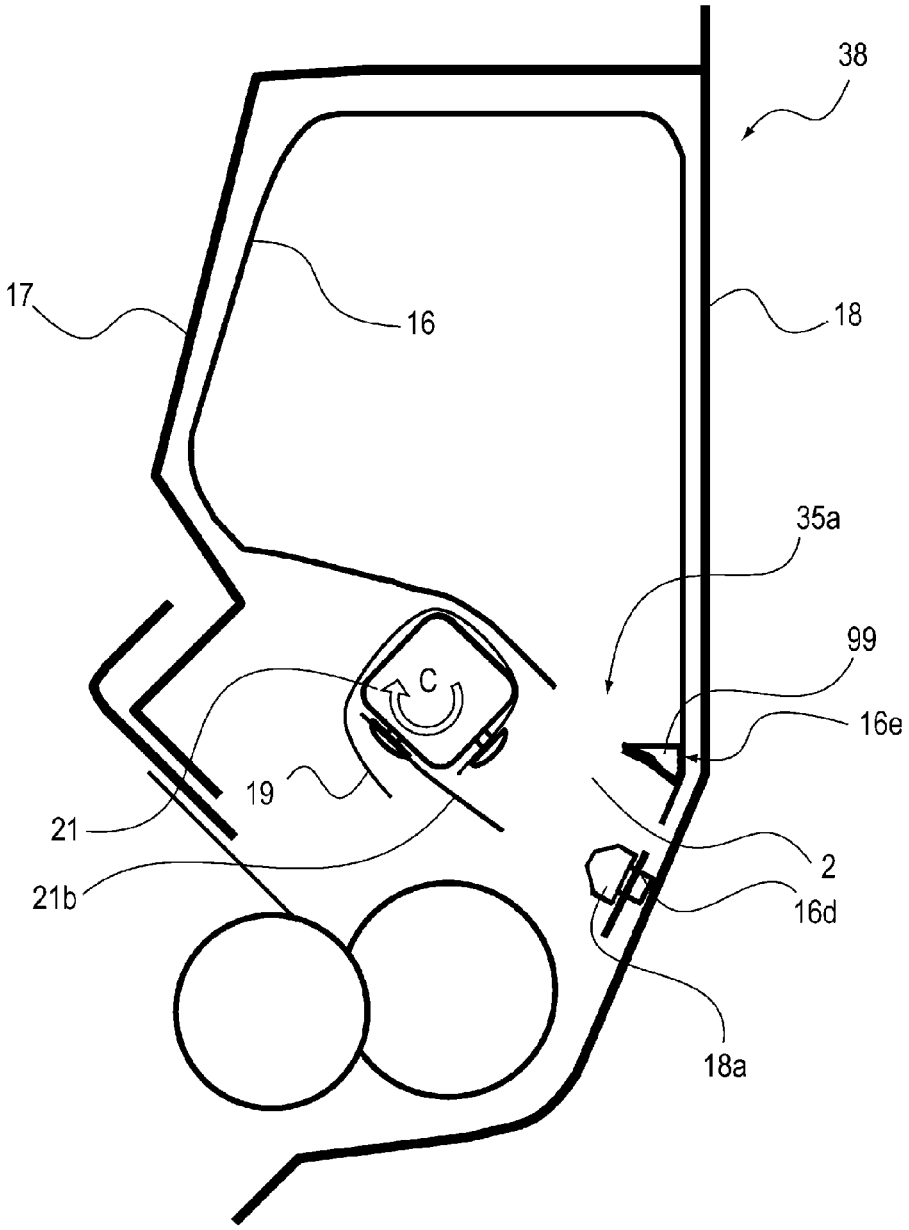

FIG. 11 is a sectional illustration showing a structure of a developing device of the developer accommodating unit in Embodiment 2.

Figure 12:
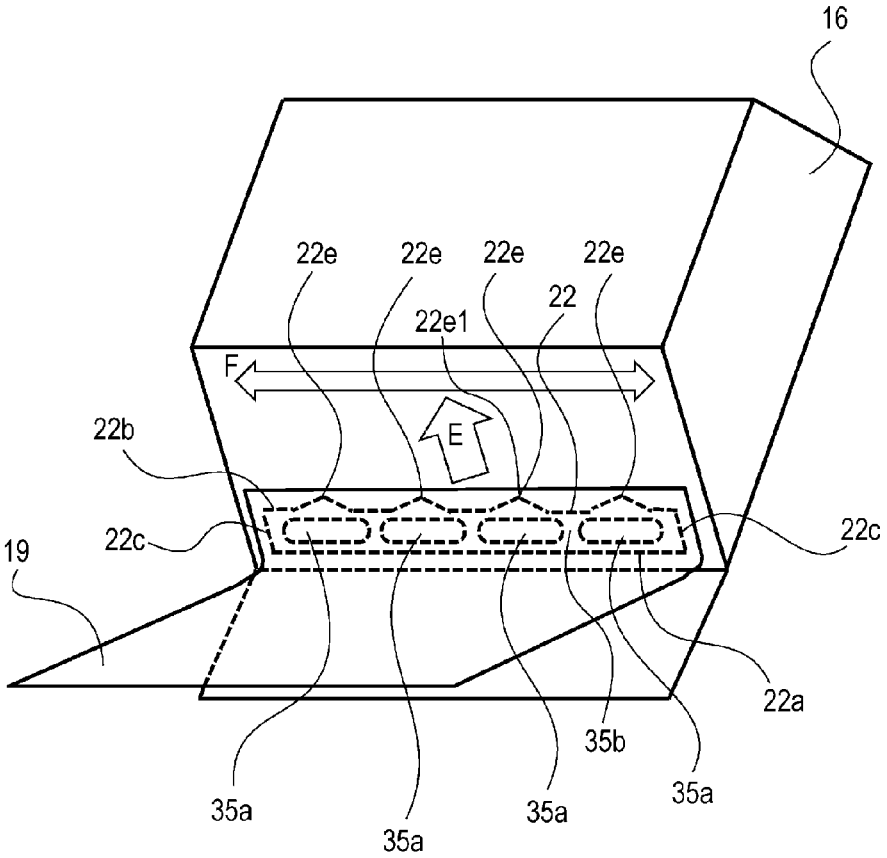

FIG. 12 is a perspective illustration showing a structure of a developing device of a developer accommodating unit in Embodiment 3 of the present invention.

Figure 13:
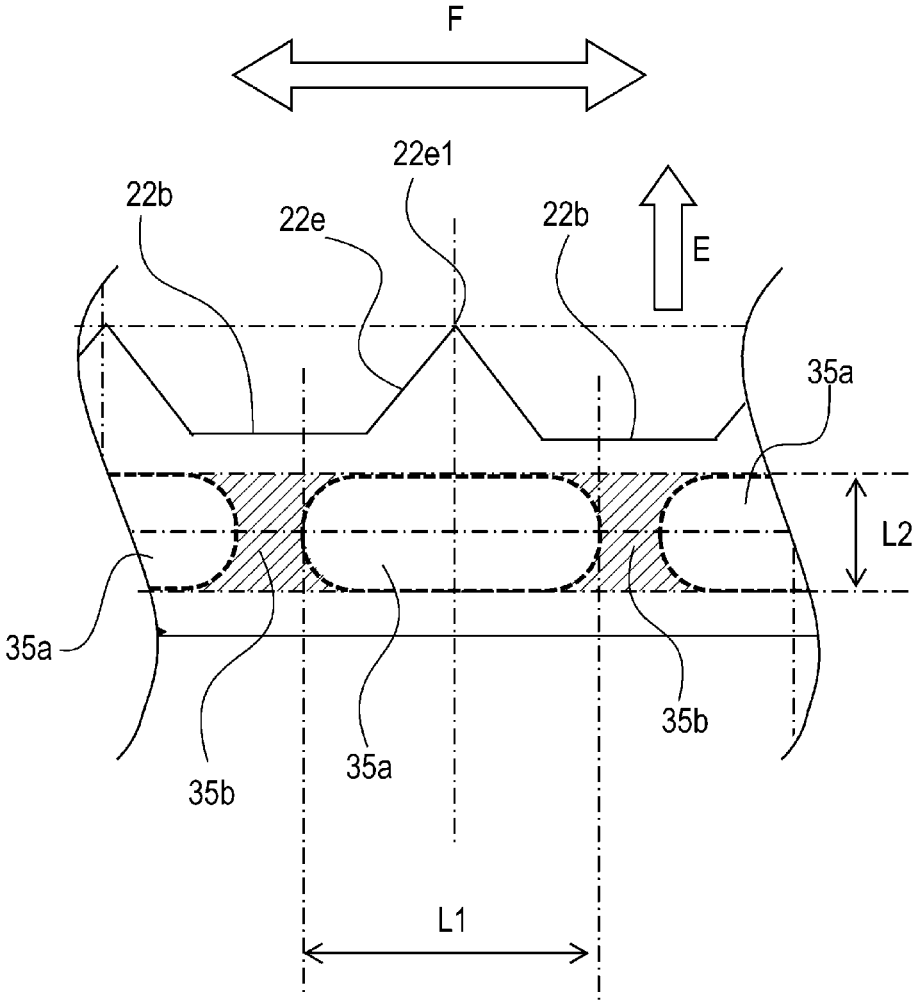

FIG. 13 is a plan illustration showing structures of a plurality of openings, connecting portions each provided between adjacent ones of the openings, and a bonding portion in the developer accommodating unit in Embodiment 3.

Figure 14:
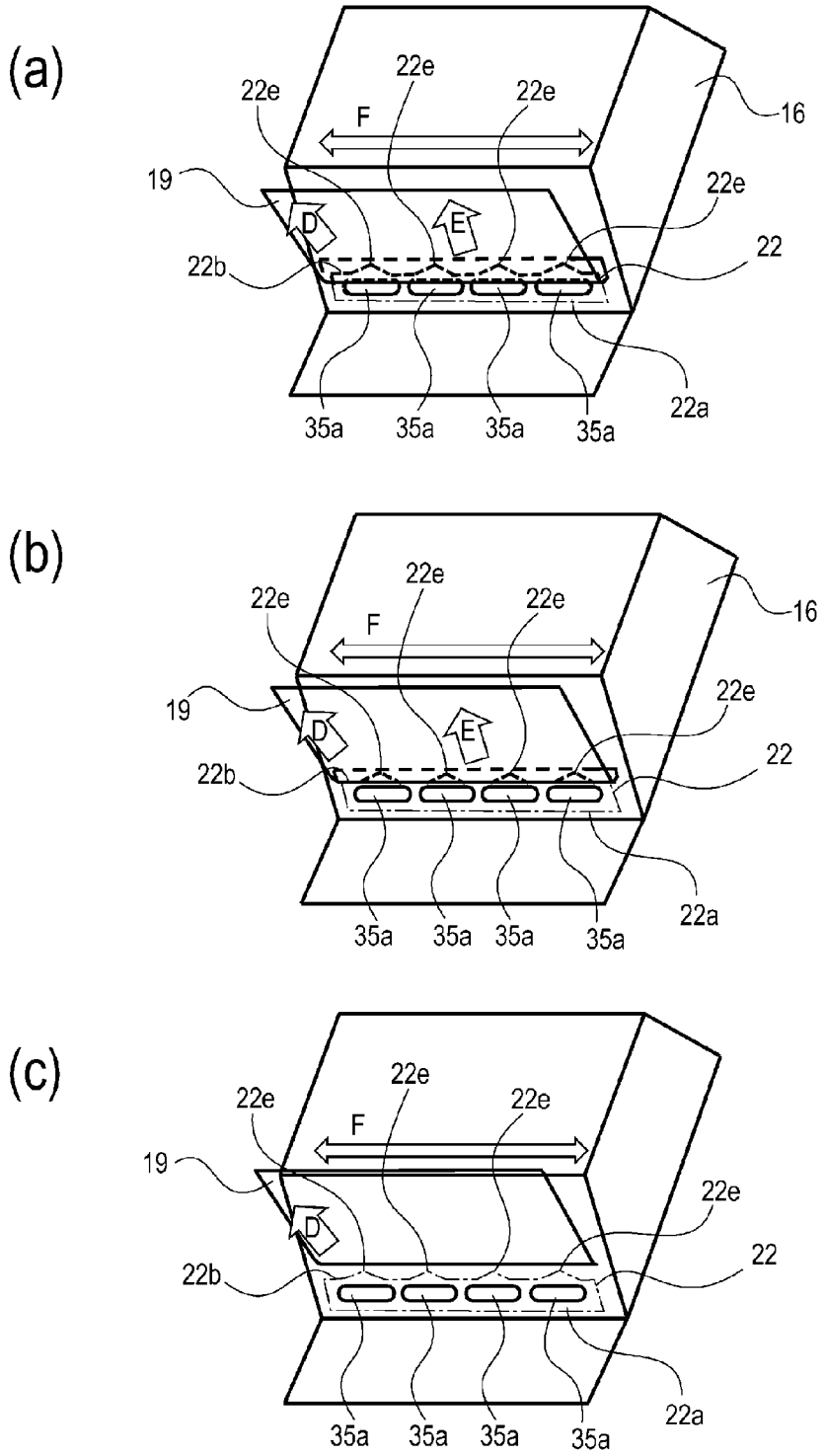

Parts (a), (b) and (c) of FIG. 14 are perspective illustrations showing a structure of a flexible container of the developer accommodating unit in Embodiment 3.

Figure 15:
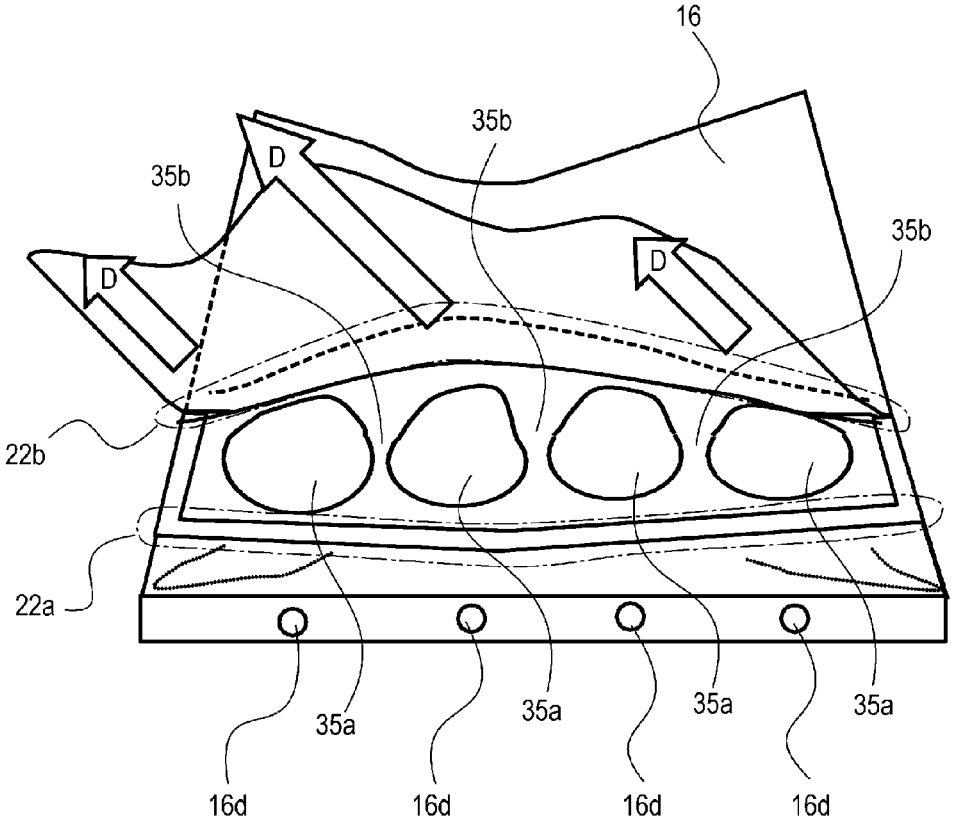

FIG. 15 is a perspective illustration showing structures of a plurality of openings, connecting portions each provided between adjacent ones of the openings, and a bonding portion in a developer accommodating unit in a comparison example.

Figure 16:
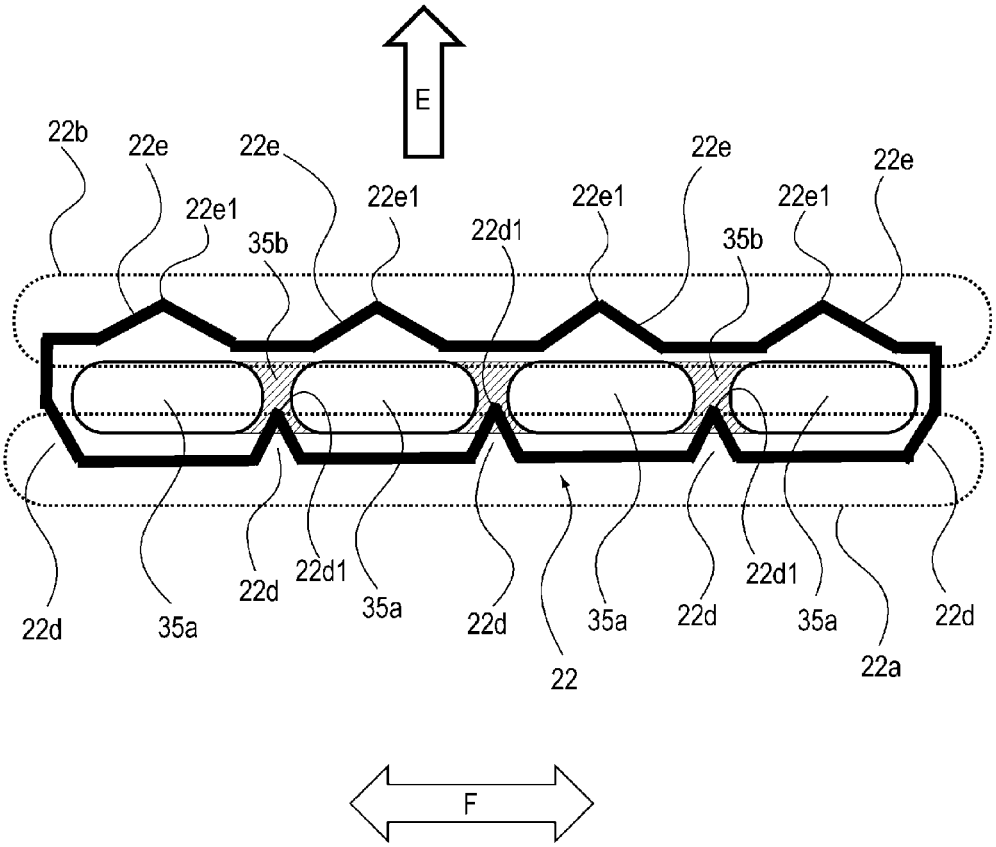

FIG. 16 is a plan illustration showing structures of a longitudinal of openings, connecting portions each provided between adjacent ones of the openings, and a bonding portion in a developer accommodating unit in Embodiment 4 of the present invention.

Figure 17:
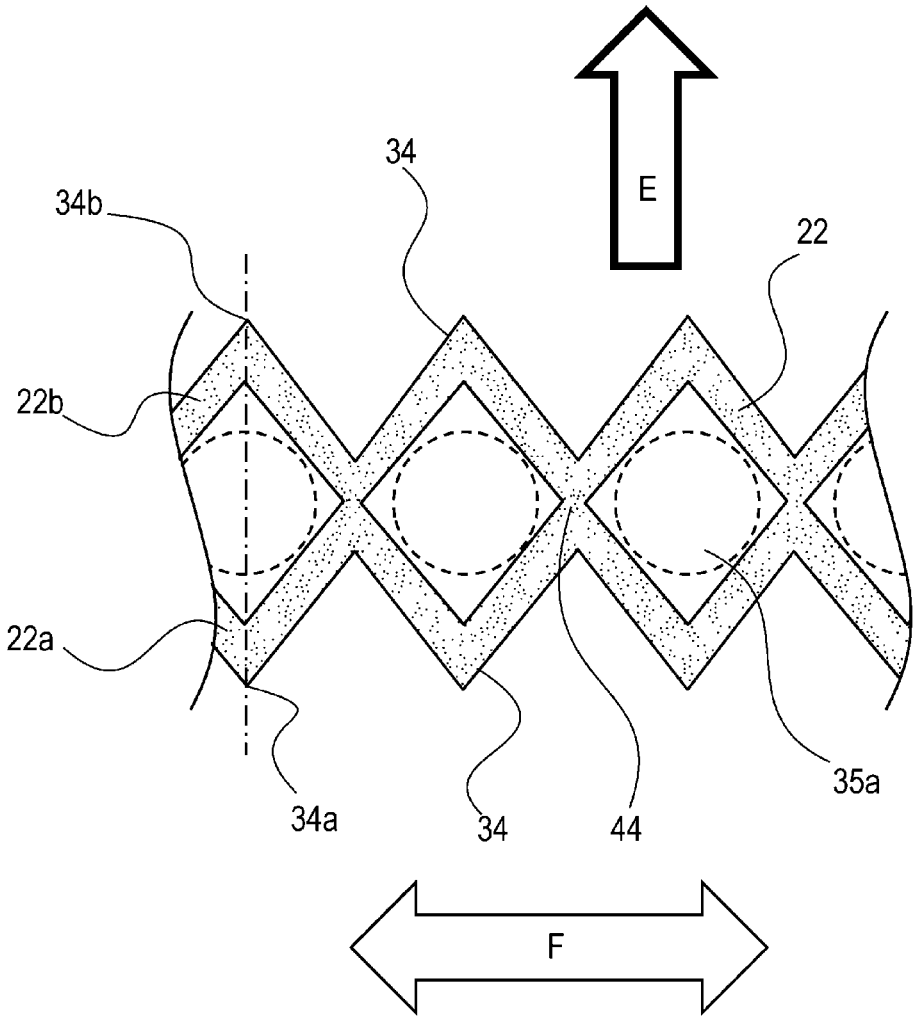

FIG. 17 is a plan illustration showing structures of a longitudinal of openings, connecting portions each provided between adjacent ones of the openings, and a bonding portion in a developer accommodating unit in Embodiment 5 of the present invention.

Figure 18:
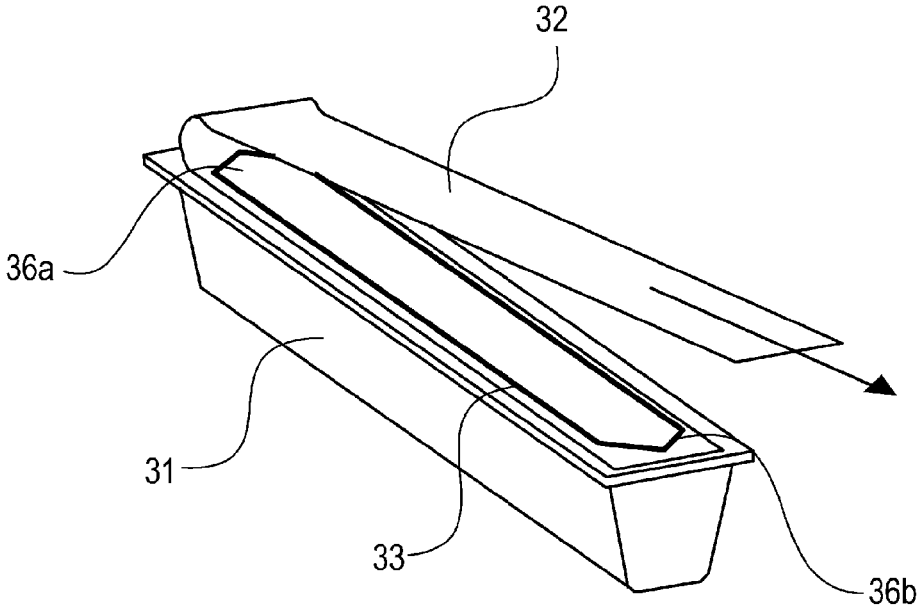

FIG. 18 is a perspective view for illustrating a conventional constitution.

DESCRIPTION OF THE PREFERRED EMBODIMENTS

Embodiments of an image forming apparatus to which a process cartridge including a developer accommodating unit according to the present invention is detachably mounted will be specifically described with reference to the drawings.

[Embodiment 1]

First, with reference to FIGS. 1 to 9, a constitution of an image forming apparatus which a process cartridge including a developer accommodating unit according to the present invention in Embodiment 1 is detachably mounted will be described.

In the following description, a developer accommodating unit generating a toner constituting a developer includes at least a developing bag 16 as a flexible container provided with a plurality of openings 35*a* for permitting discharge of the accommodated developer, and flames 17 and 18 which accommodate the developer bag 16. The flames 17 and 18 accommodated also an unsealing member 21 and include a fixing portion 18*a* for fixing the developer bag 16. The unsealing member 21 is accommodated between the flames 17 and 18.

Further, the developer accommodating unit includes a sealing member 19 for sealing the plurality of openings 35*a* and for exposing the openings 35*a* by being moved. The developer accommodating unit further includes the unsealing member 21, mounted to the sealing member 19, for moving the sealing member 19.

Further, the developer accommodating unit includes a bonding portion 22 for bonding an end portion of the sealing member 19 and a periphery of the openings 35*a* of the developer bag 16. The bonding portion 22 includes projected portions (projection-shaped portions) 22*a*1 and 22*a*2 projected outward of a closed pattern thereof indicated by a broken line in each of FIGS. 5, 9, 12 and 14, and includes a recessed portion (recess-shaped portion) 22*d* recessed inward of a closed pattern thereof indicated by a broken line in FIG. 10.

Figure 1:
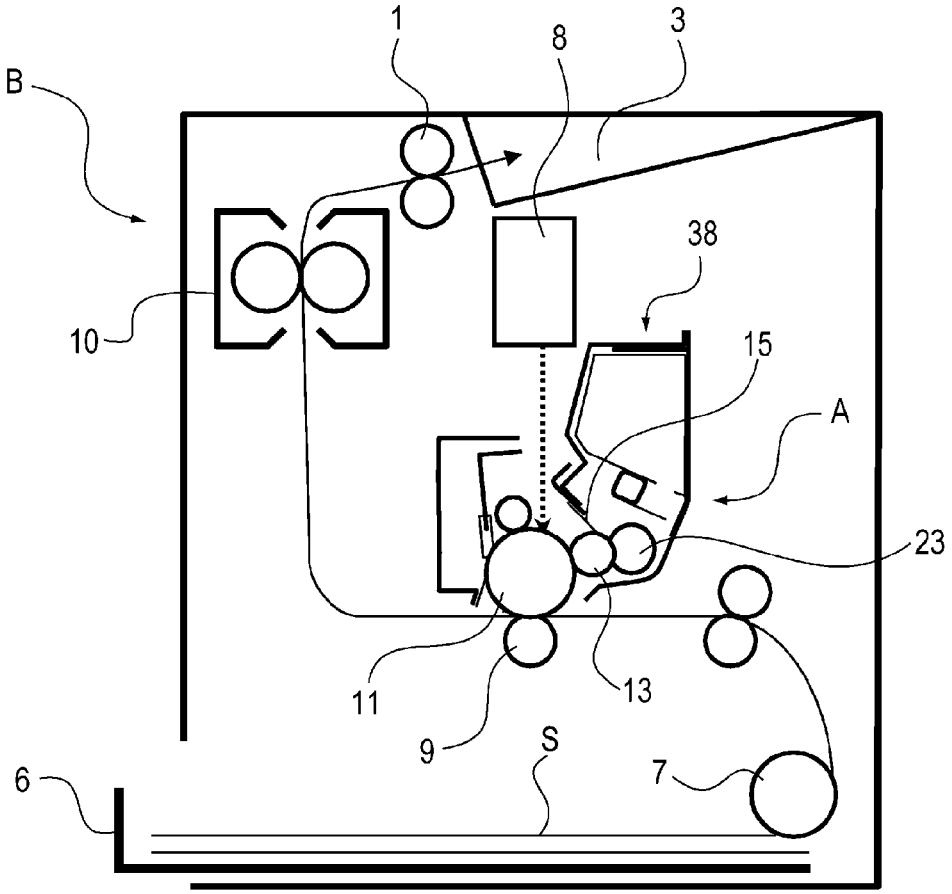
FIG. 1 is a sectional illustration showing a structure of an image forming apparatus to which a process cartridge including a developer accommodating unit according to the present invention is detachably mounted.
Figure 2:
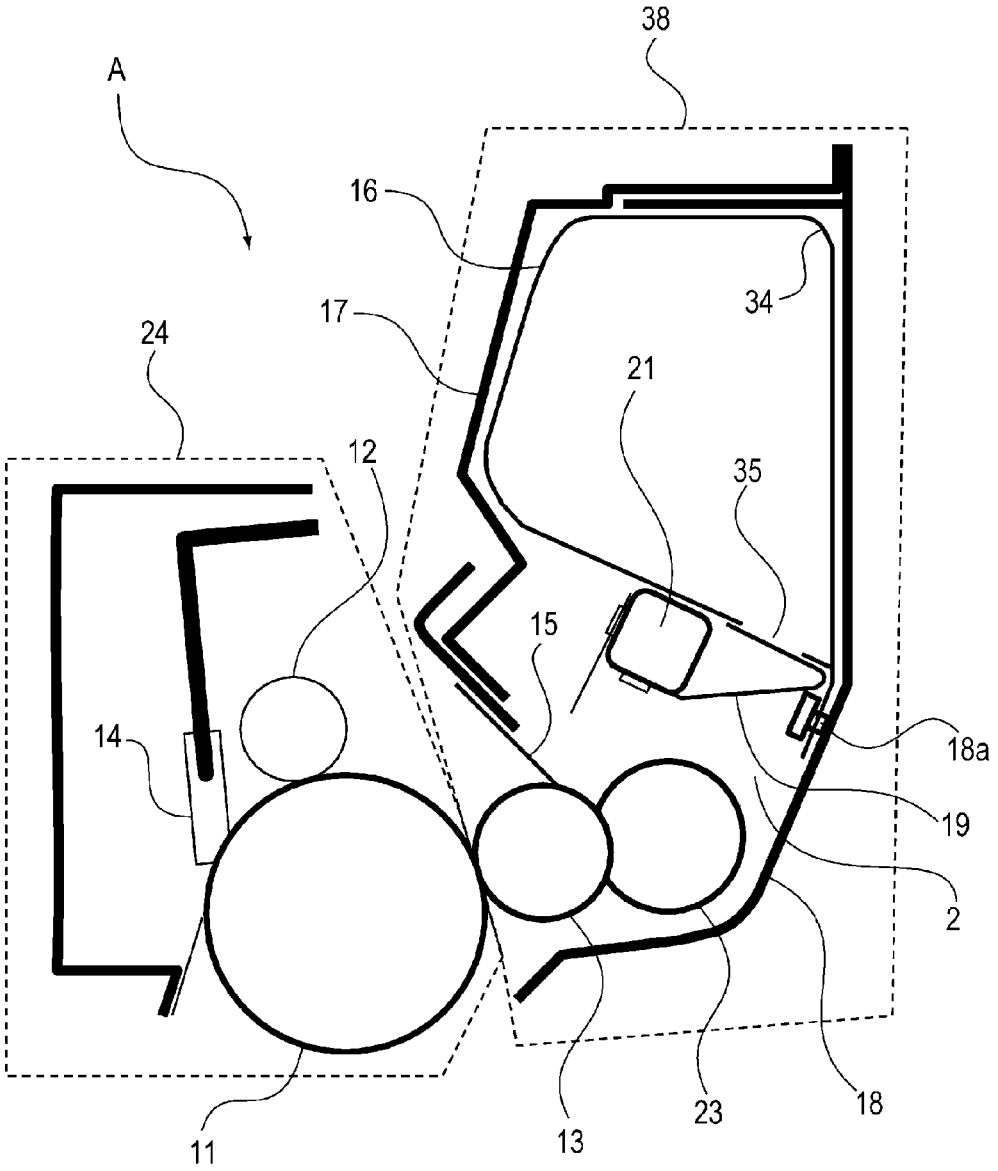
FIG. 2 is a sectional illustration showing a structure of the process cartridge including the developer accommodating unit according to the present invention.

FIG. 1 is a sectional illustration of an image forming apparatus B to which a process cartridge A including the developer accommodating unit according to the present invention is detachably mounted. FIG. 2 is a sectional illustration of the process cartridge A including the developer accommodating unit according to the present invention.

<Process Cartridge>

As shown in FIG. 2, the process cartridge A includes a photosensitive drum 11 as an image bearing member, and includes an image forming process means actable on the photosensitive drum 11.

Here, as the image forming process means, e.g., a charging roller 12 as a charging means for electrically charging the surface of the photosensitive drum 11 is used. Further, a developing device 38 for forming a toner image on the surface of the photosensitive drum 11 and a cleaning blade 14 as a cleaning means for removing the developer (containing the toner, a carrier and the like) remaining on the surface of the photosensitive drum 11.

The process cartridge A in this embodiment includes, as shown in FIG. 2, at a periphery of the photosensitive drum 11 as the image bearing member, the charging roller 12 as the charging means and a cleaning unit 24 including the cleaning blade 14, as the cleaning means, having elasticity.

Further, the process cartridge A includes the developing device 38 including the frames 17 and 18. The process cartridge A integrally includes the cleaner unit 24 and the developing device 38 and is, as shown in FIG. 1, constituted so as to be detachably mountable to a main assembly of the image forming apparatus B.

The developing device 38 includes a developing roller 13 as the developing means, a developing blade 15, a developer supplying roller 23, and the flexible developer bag 16 for accommodating the developer. The developing roller 13 and the developing blade 15 are supported by the frame 17.

<Image Forming Apparatus>

The process cartridge A is mounted in the image forming apparatus B and then is used for image formation. In the image formation, a sheet S is fed, by a feeding roller 7, from a sheet cassette 6 mounted at a lower portion of the image forming apparatus B. In synchronism with the feeding of the sheet S, the surface of the photosensitive drum 11 uniformly charged by the charging roller 12 is subjected to selective exposure to light from an exposure device 8 depending on image data, so that the electrostatic latent image is formed.

The developer is supplied to the developing roller 13 as a developer carrying member by the developer supplying roller 23 in a sponge-like shape, so that the developer is carried in a thin layer on the surface of the developing roller 13 by the developing blade 15. By applying a developing bias voltage to the developing roller 13, the developer is supplied depending on the electrostatic latent image, so that the latent image is developed into a developer image. Then, by applying a transfer bias voltage to the transfer roller 9, the developer image is transferred onto the sheet S conveyed to a nip.

The sheet S is conveyed into a fixing device 10, in which the developer image is heated and pressed to be fixed on the sheet S, and thereafter is discharged, by a discharging roller 1 onto a discharge portion 3 provided at an upper portion of the image forming apparatus B.

<Developer Bag>

Figure 3:
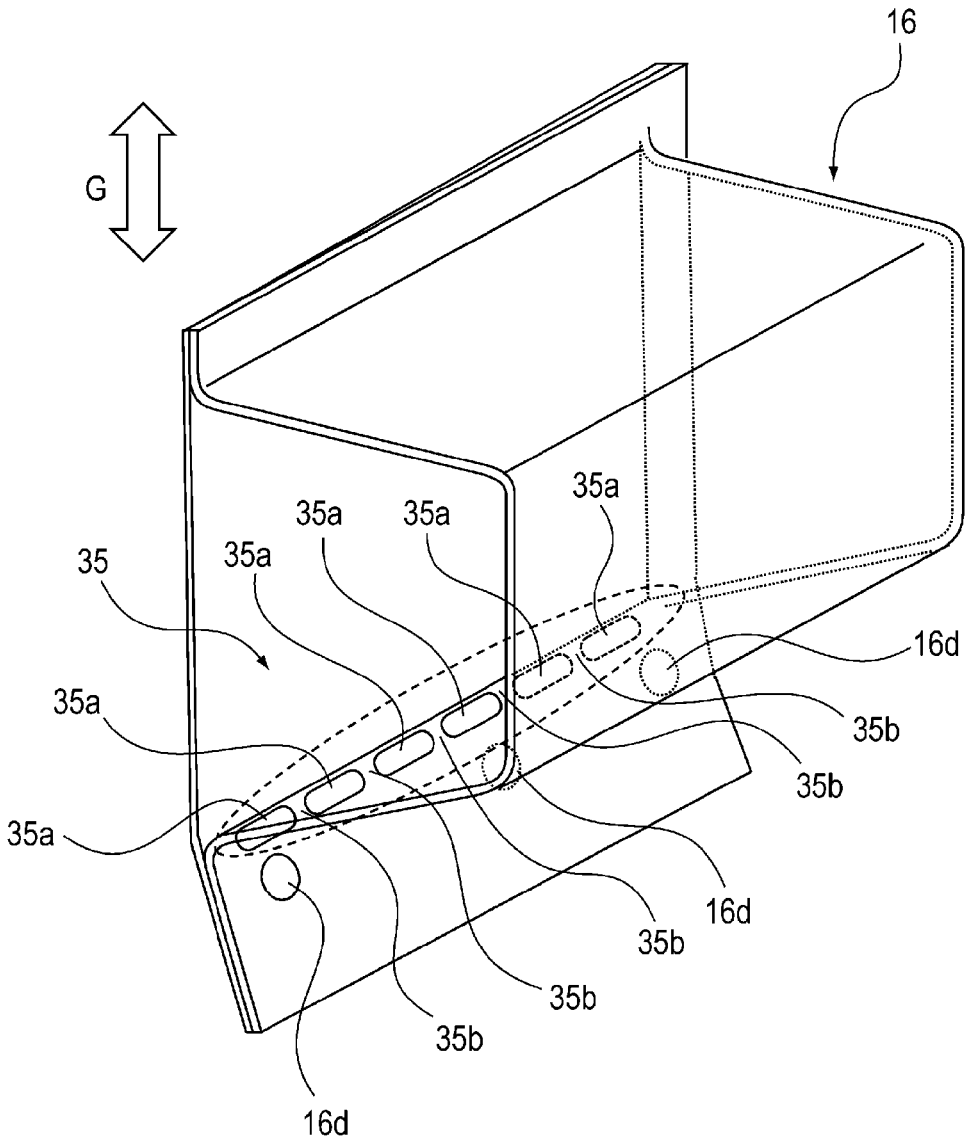
FIG. 3 is a perspective illustration showing a cross section of a part of a flexible container in the developer accommodating unit.

With reference to FIGS. 3 and 4, a constitution of the developer bag 16 will be described. FIG. 3 is a perspective illustration showing a cross section of a part of the developer bag 16. Part (a) of FIG. 4 is a sectional illustration showing a structure of the developing device 38, and (b) and (c) of FIG. 4 are sectional illustrations showing a state in which the bonding portion 22 between the sealing member 19 and the developer bag 16 is peeled with advance of rotation of the unsealing member 21 to expose the openings 35*a*.

As shown in FIG. 3, the developer bag 16 accommodates the developer therein and has a deformable bag-like shape. In order to discharge the accommodated developer, the developer bag 16 includes, at a discharging portion 35, the longitudinal of openings 35*a* and connecting portions 36*b* each provided between adjacent ones of the openings 35*a*. Each of the openings 35*a* in this embodiment has an elongated circle hole shape. Incidentally, as the shape of each of the openings 35*a*, in addition to the elongated circle hole shape, it is possible to appropriately employ shapes of a round hole, a rectangular hole, and the like. The shape of each opening 35*a* may only be required to be appropriately selected in view of a necessary amount of discharge of the toner (developer) from the developer bag 16, strength of the developer bag 16 in the neighborhood of the openings 35*a*, and the like.

Further, as shown in FIG. 4, before use of the developer bag 16, a periphery of the openings 35*a* is continuously surrounded by the bonding portion 22 having a loop-like shape indicated by a broken line in FIG. 5, and then is unsealably sealed with the sealing member 19, so that the toner constituting the developer is accommodated in the developer bag 16.

The bonding portion 22 includes a first bonding portion 22*a* in an upstream side (lower side in FIG. 5) of the openings 35*a* with respect to an unsealing direction (arrow E direction in FIG. 5) in the case where the bonding portion 22 is seen along a surface of the sealing member 19. Further, the bonding portion 22 includes a second bonding portion 22*b*, opposing the first bonding portion 22*a* via the openings 35*a*, in a downstream side (upper side in FIG. 5) of the openings 35*a* with respect to the unsealing direction (arrow E direction in FIG. 5). Further, a widthwise bonding portion 22*c* for connecting an end portion of the first bonding portion 22*a* and an associated end portion of the second bonding portion 22*b* is provided, continuously to the first and second bonding portions 22*a* and 22*b*, at each of longitudinal end portions of the bonding portion 22.

The sealing member 19 is engaged with the unsealing member 21 in other end side opposite from the bonding portion 22 side where the periphery of the openings 35*a* is sealed. The unsealing member 21 is rotatably shaft-supported at end portions thereof by the flame 18, and is rotationally driven by an unshown driving means provided in the image forming apparatus B. Further, as shown in FIG. 3, the developer bag 16 includes a fixed portion 16*d* engaged with the fixing portion 18*a* of the flame 18.

<Bonding Portion of Developer Bag>

With reference to FIG. 4, a constitution of the bonding portion 22 of the developer bag 16 will be described. FIG. 5 is perspective view of the developer bag 16.

The bonding portion indicated by the broken line in FIG. 5 is provided with a sealant layer in the sealing member 19 side, and is bonded to the periphery of the openings 35*a* of the developer bag 16 by welding.

Along a longitudinal direction (arrow F direction in FIG. 5) of the developer accommodating unit, the bonding portion 22 includes two bonding portions consisting of the first bonding portion 22*a* and the second bonding portion 22*b* and includes, along a widthwise direction (arrow E direction in FIG. 5) of the developer accommodating unit, two bonding portions each consisting of the widthwise bonding portion 22*c*. These bonding portions are continuously generated (connected) to each other in a shape such that the bonding portions surround the openings arranged in a direction crossing (perpendicular to) the unsealing direction (arrow E direction) of the openings 35*a*. For this reason, the sealing of the openings 35*a* is enabled.

Here, of the two bonding portions 22*a* and 22*b* welded along the longitudinal direction (arrow F direction in FIG. 5) of the developer accommodating unit, a bonding portion to be unsealed earlier is the first bonding portion 22*a* and a bonding portion to be unsealed later is the second bonding portion 22*b*. The bonding portion opposing the first bonding portion 22*a* via the openings 35*a* is the second bonding portion 22*b*. The bonding portions each connected with the two bonding portions 22*a* and 22*b* along the widthwise direction (arrow E direction in Embodiment 5) of the developer accommodating unit are the widthwise bonding portions 22*c*.

In this embodiment, the plurality of projected portions 22*a*1 and 22*a*2 each projected toward the upstream side (lower side in FIG. 5) with respect to the unsealing direction (arrow E direction) which is a direction in which the unsealing of the first bonding portion advances are provided. Each of the projected portions 22*a*1 and 22*a*2 is projected toward the upstream side (lower side in FIG. 5) with respect to the unsealing direction (arrow E direction) in a plane of the first bonding portion 22*a* at each of longitudinal end portions of the first bonding portion 22*a*. These projected portions 22*a*1 and 22*a*2 are provided in position, of the first bonding portion 22*a*, corresponding to the end portions where the unsealing member 21 is supported.

When the unsealing member 21 is rotated to wind the sealing member 19 about an outer peripheral surface thereof and thus is pulled, at first, the unsealing of the first bonding portion 22*a* of the bonding portion 22 is started. At that time, portions which are peeled first as a trigger for the peeling are the projected portions 22*a*1 and 22*a*2. These projected portions 22*a*1 and 22*a*2 are provided at the end portions of the first bonding portion 22*a* with respect to the arrow F direction perpendicular to the unsealing direction (arrow E direction) as the direction in which the unsealing of the first bonding portion 22*a* advances.

Further, the first bonding portion 22*a*, the projected portion 22*a*1 provided at a left end portion of the first bonding portion 22*a* in FIG. 5, and the widthwise bonding portion 22*c* provided in a left side in FIG. 5 are continuously bonded (connected). Further, the second bonding portion 22*b*, the widthwise bonding portion 22*c* provided in a right side in FIG. 5, and the projected portion 22*a*2 provided at a right end portion of the first bonding portion 22*a* are continuously bonded (connected).

Here, provision of the projected portions 22*a*1 and 22*a*2 in the plane of the bonding portion 22 means that the projected portions 22*a*1 and 22*a*2 are provided at a part of the bonding portion 22 in the plane of the bonding portion 22 based on the assumption of a phantom plane including the bonding portion 22.

<Arrangement of Openings of Developing Bag>

Next, with reference to FIGS. 4 and 5, arrangement of the openings 35*a* provided in the developer bag 16 will be described.

As shown in FIG. 4, a movement direction (pulling direction) of the sealing member 19 for sealing the openings 35*a* provided in the developer bag 16 and for exposing the openings 35*a* by being moved is an arrow D direction in (a) of FIG. 4.

By the movement of the sealing member 19 in the arrow D direction of FIG. 4, the exposure of the openings 35*a* advances in the unsealing direction which is the arrow E direction of FIG. 5. The plurality of openings 35*a* are formed with predetermined pitches with respect to the arrow F direction which crosses which is (perpendicular to) the unsealing direction as the arrow E direction of FIG. 5 and which is the longitudinal direction of the developer accommodating unit, and each of connecting portions 35*b* is provided between adjacent ones of the openings 35*a*. Further, the sealing member 19 is fixed at an end portion thereof on an outer peripheral surface of the unsealing member 21 and has a constitution in which the sealing member 19 is wound up about the outer peripheral surface of the unsealing member 21 by rotating the unsealing member 21. A rotational axis direction of the unsealing member 21 is parallel to the arrow F direction shown as the longitudinal direction in FIG. 5.

A rotational axis direction of the developing roller 13 shown in (a) of FIG. 4 and the arrow F direction along which the plurality of openings 35*a* are arranged are made parallel to each other. As a result, when the developer in the developing bag 16 is discharged through the openings 35*a*, the developer is supplied uniformly over the longitudinal direction of the developing roller 13.

<Sealing Member>

Next, with reference to FIG. 5, a constitution of the sealing member 19 will be described. As shown in FIG. 5, the sealing member 19 includes a sealing portion 19*a* for sealing (covering) the developing bag 16 to confine the developer in the developing bag 16 before use of the process cartridge A and includes an engaged portion 19*b* engaged with the unsealing member 21, and is formed in a sheet shape. The engaged portion 19*b* is engaged with the unsealing member 21 for exposing the openings 35*a* by being rotated to move the sealing member 19 in the arrow D direction in (a) of FIG. 4. The unsealing member 21 is provided rotatably about a rotation shaft provided in the frame 18. Further, the sealing member 19 includes a fold-back portion 19*d* folded back at a portion between the sealing portion 19*a* and the engaged portion 19*d*.

<Unsealing Member>

Next, with reference to FIG. 4, a constitution of the unsealing member 21 will be described. The unsealing member 21 applies a force to the sealing member 19 to move the sealing member 19, so that the sealing member 19 is peeled off from the developing bag 16. The unsealing member 21 includes an unshown supporting portion which has a shaft shape and which is rotatably supported by the frame 18 at its end portions, and includes the engaging portion 21*c* for fixing the engaged portion 19*b* of the sealing member 19. Further, the unsealing member 21 includes an urging sheet 21*b*.

<Unsealing Operation of Developing Bag>

Next, with reference to FIGS. 4 to 7, an unsealing operation of the developing bag 16 will be described. Part (a) of FIG. 4 is a sectional illustration of the developing device 38 immediately before the developer bag 16 is unsealed, and (b) and (c) of FIG. 4 are parted sectional illustrations showing a structure in the neighborhood of the openings 35*a*. FIG. 6 is a graph for illustrating a peeling force when the sealing member 19 is unsealed, and FIG. 7 is a sectional illustration showing a structure of the developing device 38. Here, in the order from (a) of FIG. 4 to (b) of FIG. 4, the unsealing operation advances.

As shown in FIG. 4, by a driving force transmitted from a driving source provided in the image forming apparatus B, the unsealing member 21 is rotated in an arrow C direction in (a) of FIG. 4, so that the sealing member 19 is pulled in the arrow D direction in (a) of FIG. 4 to gradually expose the openings 35*a*. At this time, the sealing member 19 exposes the openings 35*a* while maintaining the fold-back portion 19*d*. For this reason, the bonding portion 22 is not in a state of shearing peeling (approximately 0-degree peeling), and therefore the unsealing of the sealing member 19 can be advanced.

As shown in (b) and (c) of FIG. 4, the developer bag 16 is fixed to the fixing portion 18*a* of the flame 18 by the fixed portion 16*d*. For this reason, first, as shown from (a) of FIG. 4 to (b) of FIG. 4, when the rotation of the unsealing member 21 in the arrow C direction is started, the sealing member 19 fixed to the unsealing member 21 is pulled in the arrow D direction in (a) and (b) of FIG. 4, so that the unsealing starts. At this time, the unsealing of the bonding portion 22 starts from the first bonding portion 22*a*.

In this embodiment, as shown in FIG. 5, the projected portions 22*a*1 and 22*a*2 disposed so as to be projected toward the upstream side (lower side in FIG. 5) with respect to the arrow E direction in FIG. 5 as the direction in which the unsealing advances are provided. For this reason, a peeling force generated by the pulling of the sealing member 19 concentratedly acts on the projected portions 22*a*1 and 22*a*2, so that the unsealing of the first bonding portion 22*a* advances from the projected portions 22*a*1 and 22*a*2 as the trigger of the unsealing.

Here, with respect to the longitudinal direction (arrow F direction in FIG. 5) of the first bonding portion 22*a*, with a longer distance in which the peeling of the first bonding portion 22*a* is generated simultaneously, a peak 40 of the peeling force shown in FIG. 6 becomes larger. In this embodiment, the projected portions 22*a*1 and 22*a*2 disposed so as to be projected toward the upstream side (lower side in FIG. 5) with respect to the arrow E direction in FIG. 5 as the direction in which the unsealing of the first bonding portion 22*a* advances are provided. For this reason, when the peeling of the first bonding portion 22*a* occurs, it becomes possible to suppress generation of the peak 40 of the peeling force shown in FIG. 6 to reduce the peeling force.

Further, during start of the unsealing of the first bonding portion 22*a*, when the force for unsealing the unsealing member 21 is applied to the unsealing member 21, the unsealing member 21 is pulled by the sealing member 19 in a direction opposite to the arrow D direction shown in (a) of FIG. 4. The unsealing member 21 is supported at the ends thereof by the flame 18. For this reason, the unsealing member 21 is not a little flexed in the direction opposite to the arrow D direction shown in (a) of FIG. 4.

A degree of this flexure of the unsealing member 21 is smallest in the neighborhood of each of portions closer to the end where the unsealing member 21 is supported, and is largest in the neighborhood of a central portion, remote from the end where the unsealing member 21 is supported, with respect to an axial direction of the unsealing member 21. That is, the first bonding portion 22*a* is pulled by the sealing member 19 fixed to the unsealing member 21 in a manner such that portions thereof in the neighborhood of the ends are not a little peeled earlier than a portion in the neighborhood of the longitudinal central portion thereof, so that the unsealing advances.

In this embodiment, with respect to the arrow F direction in FIG. 5, the first bonding portion 22*a* is provided with the positions 22*a*1 and 22*a*2 at the end portions thereof where the unsealing starts earlier. For that reason, even when the flexure is not a little generated in the unsealing member 21, it is possible to start the unsealing of the first bonding portion 22*a* with reliability from the projected portions 22*a*1 and 22*a*2 as the trigger of the unsealing.

Thereafter, as shown from (b) of FIG. 4 to (c) of FIG. 4, with advance of the rotation of the unsealing member 21 in the arrow C direction, the widthwise bonding portions 22*c* provided continuously from the first bonding portion 22*a* through the second end portions of the first bonding portion 22*a* are peeled. Then, the longitudinal of openings 35*a* are exposed, and finally the second bonding portion 22*b* provided continuously from the widthwise bonding portions 22*c* through longitudinal end portions of the second bonding portion 22*b* is peeled, as shown in FIG. 5, the deformation of the openings 35*a* is suppressed by the connecting portions 35*b* each provided between adjacent ones of the openings so as to bridge the first bonding portion 22*a* and the second bonding portion 22*b*.

By employing such a constitution, the second bonding portion 22*b* can be mode peelable with reliability. When the unsealing is completed, the openings 35*a* are completely exposed, so that the developer in the developer bag 16 is discharged in an arrow I direction in (c) of FIG. 4 through the openings 35*a*, into a toner supplying chamber 2 in which the developer supplying roller 23 is provided.

After the unsealing of the sealing member 19, as shown from (a) of FIG. 7 to (b) of FIG. 7, the unsealing member 21 is rotated in the arrow C direction shown in FIG. 7. As a result, deformation and contraction of the developer bag 16 by unsealing of the developer bag 16 with an urging sheet 21*b* provided on the unsealing member 21 in an arrow J direction in (a) of FIG. 7 and shape restoration of the developer bag 16 in an arrow K direction by the weight of the developer inside the developer bag 16 and flexibility of the developer bag 16 are repeated. As a result, the developer inside the developer bag 16 is discharged into the toner supplying chamber 2 through the openings 35*a*.

In this way, the projected portions 22*a*1 and 22*a*2 projected toward the upstream side (lower side in FIG. 5) with respect to the arrow E direction in FIG. 5 in which the unsealing of the first bonding portion 22*a* advances. Further, the projected portions 22*a*1 and 22*a*2 are provided at the end portions of the first bonding portion 22*a* with respect to the arrow F direction in FIG. 5 perpendicular to the arrow E direction in FIG. 5 in which the unsealing of the first bonding portion 22*a* advances.

By employing such a constitution, when the peeling of the first bonding portion 22*a* is generated, it is possible to start the unsealing from the projected portions 22*a*1 and 22*a*2 as the trigger of the unsealing so that the generation of the peak 40 of the peeling force shown in FIG. 6 can be suppressed and thus the peeling force can be reduced.

<Another Example of Constitution of the Bonding Portion of Developer Bag>

Next, with reference to FIGS. 8 and 9, another example of the constitution of the bonding portion 22 of the developer bag 16 will be described. FIGS. 8 and 9 are perspective illustrations each showing a structure in the neighborhood of the openings 35*a* and the bonding portion 22.

In this embodiment, the bonding portion 22 for sealing the openings 35*a* was formed in a shape such that the openings 35*a* is continuously surrounded by the first bonding portion 22*a* including the projected portion 22*a*1 and 22*a*2, the second bonding portion 22*b* and the widthwise bonding portions 22*c*.

As another example of the constitution of the bonding portion 22, as shown in FIG. 8, a bonding portion 22 bonded to the periphery of the openings 35*a* by whole-surface welding is provided. Further, the bonding portion 22 is provided, at end portions thereof with respect to the longitudinal direction (arrow F direction in FIG. 8) of the bonding portion 22, with projected portions 22*a*1 and 22*a*2 projected toward an upstream side (lower side in FIG. 8) with respect to the arrow E direction in FIG. 8 as the unsealing direction of the openings 35*a*. Even when such a constitution is employed, a similar effect can be obtained.

When the unsealing of the bonding portion 22 constituting a bonding portion is started, the unsealing of the bonding portion 22 advances from the projected portions 22*a*1 and 22*a*2 as the trigger for the unsealing. Even when such a constitution is employed, it is possible to suppress the generation of the peak 40 of the peeling force shown in FIG. 6 to reduce the peeling force.

Further, in this embodiment, as the trigger when the first bonding portion 22*a* is unsealed, the projected portions 22*a*1 and 22*a*2 were provided at the longitudinal end portions of the first bonding portion 22*a* with respect to the arrow F direction in FIG. 8 perpendicular to the arrow E direction in FIG. 8 in which the unsealing advances.

As another constitution of the bonding portion 22, as shown in FIG. 9, the bonding portion 22 is constituted as follows with respect to the arrow F direction in FIG. 9 perpendicular to the arrow E direction in FIG. 9 in which the unsealing advances. At a longitudinal central portion of the first bonding portion 22*a*, a projected portion 22*a*3 projected toward an upstream side (lower side in FIG. 9) with respect to the arrow E direction in FIG. 9 in which the unsealing of the first bonding portion 22*a* advances.

In this case, a projection amount X2 of the projected portion 22*a*3 from a rectilinear portion of the first bonding portion 22*a* is provided so as to be not less than a projection amount X1 of the unsealing member 21 at the central portion with respect to the axial direction of the unsealing member 21. As a result, by using the projected portion 22*a*3 as the trigger for the unsealing with reliability, it is possible to perform the unsealing of the first bonding portion 22*a* and thus a similar effect can be obtained.

[Embodiment 2]

Next, with reference to FIGS. 10 and 11, a constitution of an image forming apparatus to which a process cartridge including a developer accommodating unit according to the present invention in Embodiment 2 is detachably mounted will be described. Incidentally, constituent elements similar to those in the above-described Embodiment 1 are represented by the same reference numerals or symbols and will be omitted from description. FIG. 10 is a perspective illustration of the developer bag 16, and FIG. 11 is a sectional illustration of the developing device 38. In this embodiment and later embodiments, a difference from the above-described embodiment(s) will be specifically described. Unless otherwise specified particularly, materials, shapes and the like are the same as those in the above-described embodiment(s).

In Embodiment 1 described above, as the trigger when the first bonding portion 22*a* is unsealed, the projected portions 22*a*1 and 22*a*2 projected toward the upstream side with respect to the arrow E direction in which the unsealing of the first bonding portion 22*a* advances are provided.

In this embodiment, as indicated by a broken line in FIG. 10, a first bonding portion 22*a* is provided in an upstream side (lower side in FIG. 10) with respect to the arrow E direction in FIG. 10 as the unsealing direction of the openings 35*a*. In a plane of the first bonding portion 22*a*, a plurality of recessed portions (recess-shaped portions) 22*d* recessed toward a downstream side (upward direction in FIG. 10) with respect to the arrow E direction in FIG. 10 as the unsealing direction in which the unsealing advances are provided. Further, at least a part of the recessed portions 22*d* enters a region of connecting portions 35*b*.

Also in such a constitution, it is possible to obtain an effect similar to the effect in Embodiment 1. Further, in this embodiment, the recessed portions 22*d* are disposed in positions associated with the connecting portions 35*b* in the following manner. Along an extension line of the arrow E direction in FIG. 10 in which the unsealing advances, the recessed portions 22*d* are disposed so that at least a part of each of the recessed portions 22*d* enters the region of an associated connecting portion 36*b* provided between associated adjacent ones of the openings 35*a* shown in FIG. 10.

Here, provision of the recessed portions 22*d* in the plane of the bonding portion 22 means that the recessed portions 22*d* are provided at a part of the bonding portion 22 in the plane of the bonding portion 22 based on the assumption of a phantom plane including the bonding portion 22.

By the rotation of the unsealing member 21 in the arrow C direction in FIG. 11, the unsealing of the first bonding portion 22*a* starts from projected portions, each having a predetermined width, other than the recessed portions 22*d* of the first bonding portion 22*a* indicated by the broken line in FIG. 10, as the trigger for the unsealing. By forming the recessed portions 22*d* in such a shape, a longitudinal distance of the first bonding portion 22*a* in which the peeling of the first bonding portion 22*a* is generated simultaneously with respect to the arrow F direction in FIG. 10 can be made short, so that it is possible to suppress the peak 40 of the peeling force shown in FIG. 6.

Further, the developer bag 16 includes a corner portion 16*e* shown in FIG. 11 at a lower portion thereof in the upstream side (lower side in FIG. 11) with respect to the arrow E direction in FIG. 10 in which the exposure of the openings 35*a* advances. As shown in FIG. 11, the corner portion 16*e* constitutes a portion where it is difficult to discharge the developer in the developer bag 16 through the openings 35*a* when the discharge of the developer advances and thus an amount of the developer becomes small. Then, the developer 99 not a little remains in the corner portion 16*e*.

For that reason, when a volume of the corner portion 16*e* of the developer bag 16 becomes large, an amount of the developer which is not readily discharged from the developer bag 16 is increased, so that a residual developer 99 remaining in the developer bag 16 is increased in amount. In the case of the recessed portions 22*d* disposed in this embodiment, as shown in FIG. 10, a most recessed portion 22*d*1 of each of the recessed portions 22*d* of the first bonding portion is disposed so as to enter the region of the associated connecting portion 36*b* provided between the associated adjacent ones of the openings 35*a*. As a result, a necessary area for the first bonding portion 22*a* can be minimized, and therefore, a volume of the corner portion 16*e* of the developer bag 16 shown in FIG. 11 can be minimized, so that it is possible to decrease the amount of the developer 99 remaining in the corner portion 16*e* of the developer bag 16.

For this reason, the unsealing can be started from the projected portions, each having the predetermined width, other than the recessed portions 22*d* of the first bonding portion 22, as the trigger. Further, the generation of the peak 40 of the peeling force shown in FIG. 6 can be suppressed and thus the peeling force can be reduced. Further, the generation of the peak 40 of the peeling force shown in FIG. 6 can be suppressed to reduce the peeling force. Further, the volume of the corner portion 16*e* of the developer bag 16 can be optimized so as to be minimized. For this reason, the developer 99 remaining in the corner portion 16*e* of the developer bag 16 can be made smallest in amount. Other constitutions are the same as those in Embodiment 1, and a similar effect can be obtained.

[Embodiment 3]

Next, with reference to FIGS. 12 and 15, a constitution of an image forming apparatus to which a process cartridge including a developer accommodating unit according to the present invention in Embodiment 2 is detachably mounted will be described. Incidentally, constituent elements similar to those in the above-described embodiment 5 are represented by the same reference numerals or symbols and will be omitted from description. FIG. 2 is a perspective illustration showing a structure of the developing device 38, and FIG. 13 is a plan illustration showing a structure in the neighborhood of the plurality of openings 35*a* and the bonding portion 22. Parts (a) to (c) of FIG. 14 are perspective views for illustrating an unsealing operation of the openings 35*a*, and FIG. 15 is a perspective illustration showing a structure in the neighborhood of the openings 35*a* and the bonding portion 22 in another shape.

In Embodiment 1 described above, as shown in FIG. 5, as the trigger when the first bonding portion 22*a* is unsealed, the projected portions 22*a*1 and 22*a*2 projected toward the upstream side (lower side in FIG. 5) with respect to the arrow E direction in which the unsealing of the first bonding portion 22*a* advances are provided.

In this embodiment, as shown in FIG. 12, a second bonding portion 22*b* indicated by a broken line in FIG. 12 is provided in a downstream side (upward direction in FIG. 12) with respect to the arrow E direction in FIG. 12 as the unsealing direction of the openings 35*a*.

Further, in a plane of the second bonding portion 22*b*, a plurality of projected portions 22*e* projected recessed toward a downstream side (upward direction in FIG. 12) with respect to the arrow E direction in FIG. 12 in the plane of the second bonding portion 22*b*. A most projected portion 22*e*1 of each of the projected portions 22*e* is disposed in the neighborhood of a longitudinal central portion of an associated opening 35*a*. Further, each of the projected portions 22*e* and an associated opening 35*a* thereof are disposed on the same line in the arrow E direction of FIG. 12 as the unsealing direction of the openings 35*a*.

As shown in FIG. 12, the projected portions 22*e* projected toward the downstream side (upper side in FIG. 12) with respect to the arrow E direction in FIG. 12 in which the unsealing of the second bonding portion 22*b* advances. For this reason, the unsealing of the second bonding portion 22*b* starts from the portions, as the trigger, other than the projected portions 22*e*. For this reason, similarly as in the case where the first bonding portion 22*a* is provided with the projected portions 22*a*1 and 22*a*2 as shown in FIG. 5, the generation of the peak 40 of the peeling force, shown in FIG. 6, of the second bonding portion 22*b* can be suppressed to reduce the peeling force.

Further, in this embodiment, as shown in FIG. 13, with respect to the arrow F direction in FIG. 13 perpendicular to the arrow E direction in FIG. 13 in which the unsealing advances, the most projected portion 22*e*1 of each of the projected portions 22*e* is disposed in the neighborhood of the longitudinal central portion of the associated opening 35*a*. A state in which the unsealing advances to the second bonding portion 22*b* of the developer bag 16 is shown in (a) of FIG. 14. From this state, when the rotation of the unsealing member 21 in the arrow C direction further advances, the sealing member 19 is further pulled and moved in the arrow D direction in (a) of FIG. 14.

At this time, as shown in FIG. 13, in some cases, a width L2 of the openings with respect to the arrow E direction in which the unsealing advances is extremely larger than a width L1 of each opening 35*a* with respect to the arrow F direction perpendicular to the arrow E direction in which the unsealing advances. In that case, a pulling effect of the connecting portions each provided between adjacent ones of the openings 35*a* is not exerted until the neighborhood of the longitudinal central portions of the openings 35*a*, so that it becomes difficult to unseal the second bonding portion 22*b* is some cases.

Here, a region of the connecting portions each provided between adjacent ones of the openings 35*a* refers to a region defined by upper and lower rectilinear lines, indicated by a chain line in FIG. 13, between which the width L2 with respect to the arrow E direction in which the unsealing of the openings 35*a* advances is shown, and left and right edges of each of the openings shown in FIG. 13.

FIG. 15 shows an example of the case where it is difficult to unseal the openings since the width L2 of the openings 35*a* with respect to the arrow E direction in FIG. 13 in which the unsealing of the openings 35*a* advances is extremely larger than the width L1 of each opening 35*a* with respect to the arrow F direction in FIG. 13 perpendicular to the arrow E direction. FIG. 15 shows a state in which the unsealing advances to the second bonding portion 22*b*.

The openings 35*a* shown in FIG. 15 has the width L2, with respect to the arrow E direction in FIG. 13 in which the unsealing thereof advances, extremely larger than the width L1 with respect to the arrow F direction in FIG. 13 perpendicular to the arrow E direction. For this reason, during the unsealing of the second bonding portion 22*b* shown in FIG. 15, the openings 35*a* are largely deformed at the longitudinal central portions thereof. As a result, the openings 35*a* largely open with respect to the arrow D direction in FIG. 15.

That is, due to the deformation of the openings 35*a* in the neighborhood of the central portions thereof, a supporting force for supporting the developer bag 16 at the fixed portion 16*d* cannot be transmitted through the openings 35*a* until the unsealing of the second bonding portion 22*b* is completed. Further, in the case where the shearing peeling (approximately 0-degree peeling) state is created by the deformation of the openings 35*a* in the neighborhood of the central portions of the openings 35*a*, compared with the case of an inclination peeling (state), a large force is required to peel the sealing member 19, so that it becomes difficult to unseal the second bonding portion 22*b*.

Also in such a case, as in this embodiment shown in FIG. 12, with respect to the arrow F direction in FIG. 12 perpendicular to the arrow E direction in which the unsealing of the openings 35*a* advances, the second bonding portion 22*b* is constituted as follows. In the plane of the second bonding portion 22*b*, the most projected portion 22*e*1 of each projected portion 22*e* provided so as to be projected toward the downstream side (upper side in FIG. 12) with respect to the arrow E direction in FIG. 12 as the unsealing direction of the openings 35*a* is disposed in the neighborhood of the longitudinal central portion of the associated openings 35*a*.

As a result, during the unsealing of the second bonding portion 22*b*, in the neighborhood of the longitudinal central portion of each opening 35*a* where the opening 35*a* is largely deformed, corresponding to a projection of the associated projected portion 22*e* provided in the downstream side with respect to the arrow E direction, it is possible to perform the unsealing at a position remote from the opening 35*a*. For this reason, it is possible to suppress the deformation of the openings 35*a* in the neighborhood of the longitudinal central portions of the openings 35*a*.

Parts (a) to (c) of FIG. 14 are perspective views each for illustrating a state of the unsealing of the second bonding portion 22*b* in this embodiment. Here, the unsealing advances in the order from (a) of FIG. 14 to (b) of FIG. 14 and then to (c) of FIG. 14. First, as shown in (a) and (b) of FIG. 14, the second bonding portion 22*b* is provided with the projected portions 22*e* projected toward the downstream side (upper side in FIG. 14) with respect to the arrow E direction in FIG. 14 in which the unsealing advances. For this reason, the unsealing advances from the portions of the second bonding portion 22*b*, as the trigger, other than the projected portions 22*e*.

For this reason, the generation of the peeling force shown in FIG. 6 at the second bonding portion 22*b* can be suppressed, so that it becomes possible to reduce the peeling force. Further, the most projected portions 22*e*1 of the projected portions 22*e* are disposed in the neighborhood of the longitudinal central portions of the openings 35*a*. For this reason, the supporting force for supporting the developer bag 16 at the fixed portion 16*d* can be transmitted to the portions of the second bonding portion 22*b*, other than the projected portions 22*e*, through the openings 35*a*.

When the rotation of the unsealing member 21 in the arrow C direction further advances, as shown from (b) of FIG. 14 to (c) of FIG. 14, the unsealing of the projected portions 22*e* disposed in the neighborhood of the longitudinal central portions of the openings 35*a* advances. At this time, in the neighborhood of the longitudinal central portions of the openings 35*a* where the openings 35*a* are largely deformed, correspondingly to the projections of the projected portions 22*e* provided in the downstream side of the arrow E direction, it is possible to perform the unsealing in the position remote from the openings 35*a*, and therefore the projected portions 22*e* can be peeled and thus the unsealing is completed.

Each of the openings 35*a* is remotest from the associated connecting portion 35*b* in a position in the neighborhood of the longitudinal central portion thereof. For this reason, the developer bag 16—supporting force at the fixed portion 16*d* is not readily transmitted to the position, and the position is in the neighborhood of the longitudinal central portion of the opening 35*a* and therefore the opening 35*a* is liable to be deformed. Further, in the case where the width L2 of the openings 35*a* with respect to the arrow E direction in which the unsealing advances is extremely larger than the width L1 of each opening 35*a* with respect to the arrow F direction perpendicular to the arrow E direction, an amount of deformation of the opening 35*a*, with respect to the arrow E direction, in the neighborhood of the longitudinal of the opening 35*a* becomes extremely larger than the (original) width L2 with respect to the arrow E direction.

For this reason, the most projected portions 22*e*1 of the projected portions 22*e* are disposed in the neighborhood of the longitudinal central portions of the openings 35*a*. As a result, correspondingly to the projections of the projected portions 22*e*, it is possible to perform the unsealing in the position remote from the openings 35*a*, so that a degree of the deformation of the openings 35*a* can be made small. Further, during the unsealing of the projected portions 22*e*, with respect to the arrow F direction in FIG. 14 perpendicular to the arrow E direction in FIG. 14 in which the unsealing advances, a distance in which the peeling of the second bonding portion 22*b* is generated can be shortened, so that it is possible to suppress the peeling force.

In this way, the projected portions 22*e* projected toward the downstream side (upper side in FIG. 14) with respect to the arrow E direction in which the unsealing of the second bonding portion 22*b* advances are provided. With respect to the arrow F direction in FIG. 14 perpendicular to the arrow E direction in FIG. 14, the most projected portions 22*e*1 of the projected portions 22*e* are disposed in the neighborhood of the longitudinal central portions of the openings 35*a*.

By employing such a constitution, it is possible to suppress the generation of the peak 40 of the peeling force shown in FIG. 6 at the second bonding portion 22*b* to reduce the peeling force, so that it is possible to suppress the deformation of the openings 35*a* in the neighborhood of the longitudinal central portions of the openings 35*a*. For this reason, the unsealing of the second bonding portion 22*b* can be advanced with reliability. Other constitutions are the same as those in the above-described embodiments, and a similar effect can be obtained.

[Embodiment 4]

Next, with reference to FIG. 16, a constitution of an image forming apparatus to which a process cartridge including a developer accommodating unit according to the present invention in Embodiment 4 is detachably mounted will be described. Incidentally, constituent elements similar to those in the above-described embodiment 5 are represented by the same reference numerals or symbols and will be omitted from description.

In the above-mentioned embodiments, each of the constitutions of the first bonding portion 22*a* and the second bonding portion 22*b* is described individually, but it is possible to obtain a similar effect also when the constitution of the first bonding portion 22*a* and the constitution of the second bonding portion 22*b* are used in combination.

FIG. 16 shows an example thereof. FIG. 16 is a plan illustration showing a structure in the neighborhood of the openings 35*a* and the connecting portions 35*b* in this embodiment. Of the bonding portion 22, the first bonding portion 22*a* is provided in the upstream side (lower side in FIG. 16) with respect to the arrow E direction in FIG. 16 as the unsealing direction of the openings 35*a* in the case where the structure is seen along the surface of the sealing member 19.

The first bonding portion 22*a* is, similarly as in Embodiment 2 described above with reference to FIG. 10, provided with the recessed portions 22*d* recessed toward the downstream side (upper side in FIG. 16) with respect to the arrow E direction in FIG. 16 in which the unsealing advances. Further, most recessed portions 22*d*1 at least as a part of the recessed portions 22*d* are provided so as to enter the region of the connecting portions 35*b*.

The second bonding portions 22*b* which is the bonding portion 22 in the downstream side (upper side in FIG. 16) with respect to the arrow E direction in FIG. 16 as the unsealing direction and which opposes the first bonding portion 22*a* via the openings 35*a* is provided. The second bonding portion 22*b* is provided with the projected portions 22*e* projected toward the downstream side (upper side in FIG. 16) with respect to the arrow E direction in which the unsealing advances, similarly as in Embodiment 3 described above with reference to FIG. 12. Further, the most projected portions 22*e*1 of the projected portions 22*e* are disposed in the neighborhood of the longitudinal central portions of the openings 35*a*.

Also in such a constitution, during the peeling of the first bonding portion 22*a*, it is possible to perform the unsealing from the projected portions, each as the trigger and each having a predetermined width, other than the recessed portions 22*d*, so that the generation of the peak 40 of the peeling force shown in FIG. 6 can be suppressed to reduce the peeling force.

Further, the most recessed portions of the recessed portions 22*d* of the first bonding portion 22*a* are provided so as to enter the region of the connecting portions 35*b*, so that as descried above with reference to FIG. 11, the volume of the corner portion 16*e* of the developer bag 16 can be optimized so as to be minimized. For this reason, it becomes possible to minimize the amount of the developer 99 remaining in the corner portion 16*e* of the developer bag 16.

Further, during the peeling of the second bonding portion 22*b*, it is possible to suppress the generation of the peak 40 of the peeling force shown in FIG. 6 at the second bonding portion 22*b* to reduce the peeling force, so that it is possible to suppress the deformation of the openings 35*a* in the neighborhood of the longitudinal central portions of the openings 35*a*. For this reason, the unsealing of the second bonding portion 22*b* can be advanced with reliability. Other constitutions are the same as those in the above-described embodiments, and a similar effect can be obtained.

[Embodiment 5]

Next, with reference to FIG. 17, a constitution of an image forming apparatus to which a process cartridge including a developer accommodating unit according to the present invention in Embodiment 5 is detachably mounted will be described. Incidentally, constituent elements similar to those in the above-described embodiment 5 are represented by the same reference numerals or symbols and will be omitted from description.

FIG. 16 is a plan illustration showing a structure in the neighborhood of the openings 35*a* and the connecting portions 35*b* in this embodiment. In this embodiment, as shown in FIG. 17, of the bonding portion 22 surrounding the openings 35*a*, the first bonding portion 22*a* is provided in the upstream side (lower side in FIG. 17) with respect to the arrow E direction in FIG. 17 as the unsealing direction of the openings 35*a* in the case where the structure is seen along the surface of the sealing member 19. Further, the second bonding portion 22*b* in the downstream side (upper side in FIG. 17 with respect to the arrow E direction in FIG. 17 as the unsealing direction of the openings 35*a* is provided. Further, a plurality of projected portions 34 are continuously provided and disposed in the plane of the first bonding portion 22*a* and the plane of the second bonding portion 22*b*.

The projected portions 34 of the first bonding portion 22*a* and the projected portions 34 of the second bonding portion 22*b* are disposed in substantially parallel to a rectilinear line connecting the end portions of the unsealing member 21 where the unsealing member 21 is rotatably supported by the flame 18, and a plurality of circular openings 35*a* are provided so that each circular opening 35*a* is disposed in a gap between opposing projected portions 34 of the first and second bonding portions 22*a* and 22*b*.

In this embodiment, an example in which the projected portions 34 are disposed over the entire longitudinal direction of the first and second bonding portions 22*a* and 22*b* is shown.

Further, the projected portions 34 of the first bonding portion 22*a* and the projected portions 34 of the second bonding portion 22*b* are disposed in parallel to each other along the arrow F direction in FIG. 17 perpendicular to the arrow E direction in FIG. 17 as the unsealing direction. As a result, it is possible to dispose, in the gaps created between the first bonding portion 22*a* and the second bonding portion 22*b*, it is possible to dispose the plurality of openings 35*a* through which the developer is to be discharged. Further, a bonding portion 22 including a continuous welding portion 44 where the first and second bonding portions 22*a* and 22*b* are connected with each other is provided. As a result, similarly as in the above-described embodiments, the sealing member 19 fixed to the unsealing member 21 is pulled, so that the developer bag 16 can be unsealed.

In this way, the first and second bonding portions 22*a* and 22*b* are partly connected with each other, so that the peeling of the first bonding portion 22*a* is easily propagated to the second bonding portion 22*b*, so that continuous peeling can be performed and thus it becomes possible to further improve an unsealing property.

Incidentally, in the above-described embodiments, the example in the case where the developer bag 16 is provided with the plurality of openings 35*a* was explained. As another example, it is also possible to provide the developer bag 16 with a single opening 35*a* to be unsealed in a direction crossing the longitudinal direction of the developer accommodating unit. Other constitutions are the same as those in the above-described embodiments, and a similar effect can be obtained.

According to the above-described constitutions of the present invention, in the developer accommodating unit using the flexible container for accommodating the developer, it is possible to facilitate the unsealing of the sealing member for sealing the openings of the flexible container.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 003261/2013 filed Jan. 11, 2013, which is hereby incorporated by reference.

What is claimed is:

1. A developer accommodating unit comprising:

a flexible container provided with an opening for permitting discharge of accommodated developer;

a sealing member for sealing the opening and for exposing the opening by being moved in an unsealing direction crossing a longitudinal direction of said developer accommodating unit; and an unsealing member, mounted to said sealing member, for moving said sealing member while deforming the opening, wherein said flexible container includes a bonding portion for bonding said sealing member, and wherein said bonding portion includes a projected portion or recessed portion (i) in a plane of said bonding portion and (ii) in an upstream side or a downstream side of the opening with respect to the unsealing direction.

2. A developer accommodating unit according to claim 1, wherein the opening is provided as a plurality of openings, and wherein said projected portion or said recessed portion includes a plurality of projected portions or a plurality of recessed portions, respectively, in the plane of said bonding portion.

3. A developer accommodating unit according to claim 2, wherein said unsealing member is supported by a frame at end portions thereof, wherein said bonding portion includes a first bonding portion in the upstream side of the openings with respect to the unsealing direction of the openings when said bonding portion is seen along a surface of said sealing member, and wherein said plurality of projected portions are disposed so as to be projected toward the upstream side with respect to the unsealing direction in a plane of said first bonding portion and are provided in positions of said first bonding portion, corresponding to end portions where said unsealing member is supported.

4. A developer accommodating unit according to claim 2, wherein said bonding portion includes a first bonding portion in the upstream side of the openings with respect to the unsealing direction of the openings when said bonding portion is seen along a surface of said sealing member, and wherein said plurality of recessed portions provided in the plane of said bonding portion are disposed so as to be recessed toward the downstream side with respect to the unsealing direction so that at least a part of a recess of said plurality of recessed portions enters a region of connecting portions between the openings.

5. A developer accommodating unit according to claim 2, wherein, when said bonding portion is seen along a surface of said sealing member, said bonding portion includes a first bonding portion in the upstream side of the openings with respect to the unsealing direction of the openings and a second bonding portion in the downstream side of the openings with respect to the unsealing direction of the openings, and wherein said plurality of projected portions are disposed so as to be projected toward the downstream side with respect to the unsealing direction of the openings in a plane of said second bonding portion.

6. A developer accommodating unit according to claim 5, wherein a most projected part of each of said projected portions is located in the neighborhood of a center of a corresponding opening.

7. A developer accommodating unit according to claim 2, wherein, when said bonding portion is seen along a surface of said sealing member, said bonding portion includes a first bonding portion in the upstream side of the openings with respect to the unsealing direction of the openings and a second bonding portion in the downstream side of the openings with respect to the unsealing direction of the openings, wherein said plurality of projected portions are disposed continuously in a plane of the first bonding portion and a plane of the second bonding portion, and wherein said projected portions of said first bonding portion and said projected portions of said second bonding portion are disposed substantially in parallel to a rectilinear line connecting end portions where said unsealing member is supported, and each of the openings is located at an interval between adjacent ones of said projected portions.

8. A developer accommodating unit according to claim 1, wherein said projected portion and the opening are disposed on the same line with respect to the unsealing direction of the opening.

9. A developer accommodating unit according to claim 1, wherein said unsealing member is accommodated in a frame.

10. A process cartridge comprising:

a developer accommodating unit according to claim 1.

11. An image forming apparatus comprising:

a developer accommodating unit according to claim 1.

12. A developer accommodating unit according to claim 1, further comprising a frame including a fixing portion for fixing said flexible container.

13. A developing device comprising:

a developer carrying member for carrying developer; and a developer accommodating unit according to claim 1.

14. A developer accommodating unit according to claim 1, wherein said unsealing member includes a sheet.

15. A developer accommodating unit according to claim 1, wherein said unsealing member is configured to be driven by a driving mechanism in an image forming apparatus.

16. An image forming apparatus comprising:

a developer accommodating unit according to claim 1.

17. A developer accommodating unit according to claim 1, wherein said projected portion includes first and second projected portions that are provided in a same upstream or downstream side of the opening with respect to the unsealing direction, and said first projected portion connects to said second projected portion.

18. A developer accommodating unit comprising:

a frame;

a flexible container provided with a plurality of openings for permitting discharge of accommodated developer inside of said frame;

a sealing member for sealing the openings and for exposing the openings by being moved; and an unsealing member, contactable with the developer and provided inside of said frame, for moving said sealing member, wherein said flexible container includes a bonding portion for bonding an end portion of said sealing member, and wherein said bonding portion includes a projected portion or a recessed portion (i) in a plane of said bonding portion and (ii) in an upstream side or a downstream side of the openings with respect to an unsealing direction of the openings.

19. A developer accommodating unit according to claim 18, wherein the openings are disposed along a direction crossing the unsealing direction of the openings.

20. A developer container accommodating unit according to claim 18, further comprising a frame including a fixing portion for fixing said flexible container.

21. A developer accommodating unit according to claim 18, wherein said bonding portion does not exist in connecting portions of said flexible container between the openings.

22. A developer accommodating unit according to claim 18, wherein said unsealing member includes a sheet.

23. A developer accommodating unit according to claim 18, wherein said unsealing member is configured to be driven by a driving mechanism in an image forming apparatus.

24. A developer accommodating unit according to claim 18, wherein said projected portion includes first and second projected portions which are provided in a same upstream or downstream side of the opening with respect to the unsealing direction, and said first projected portion connects to said second projected portion.

25. A developer container comprising:

a frame provided with a plurality of openings for permitting discharge of accommodated developer;

a sealing member for sealing the openings and for exposing the openings by being moved; and an unsealing member, mounted to said sealing member inside of said frame and contactable with the developer, for moving said sealing member, wherein said frame includes a bonding portion for bonding said sealing member, wherein said bonding portion includes a projected portion or a recessed portion (i) in a plane of said bonding portion and (ii) in an upstream side or a downstream side of the openings with respect to the unsealing direction of the openings.

26. A developer accommodating unit according to claim 25, wherein said projected portion or said recessed portion includes a plurality of projected portions or a plurality of recessed portions, respectively, in the plane of said bonding portion.

27. A developer accommodating unit according to claim 26, wherein said unsealing member is supported by said frame at end portions thereof, wherein said bonding portion includes a first bonding portion in the upstream side of the openings with respect to the unsealing direction of the openings when said bonding portion is seen along a surface of said sealing member, and wherein said plurality of projected portions are disposed so as to be projected toward the upstream side with respect to the unsealing direction in a plane of said first bonding portion and are provided in positions of said first bonding portion, corresponding to end portions where said unsealing member is supported.

28. A developer accommodating unit according to claim 26, wherein said bonding portion includes a first bonding portion in the upstream side of the openings with respect to the unsealing direction of the openings when said bonding portion is seen along a surface of said sealing member, and wherein said plurality of recessed portions provided in the plane of said bonding portion are disposed so as to be recessed toward the downstream side with respect to the unsealing direction so that at least a part of a recess of said plurality of recessed portions enters a region of said connecting portions between the openings.

29. A developer accommodating unit according to claim 26, wherein, when said bonding portion is seen along a surface of said sealing member, said bonding portion includes a first bonding portion in the upstream side of the openings with respect to the unsealing direction of the openings and a second bonding portion in the downstream side of the openings with respect to the unsealing direction of the openings, and wherein said plurality of projected portions are disposed so as to be projected toward the downstream side with respect to the unsealing direction of the openings in a plane of said second bonding portion.

30. A developer accommodating unit according to claim 29, wherein a most projected part of each of said projected portions is located in the neighborhood of a center of a corresponding opening.

31. A developer accommodating unit according to claim 26, wherein, when said bonding portion is seen along a surface of said sealing member, said bonding portion includes a first bonding portion in the upstream side of the openings with respect to the unsealing direction of the openings and a second bonding portion in the downstream side of the openings with respect to the unsealing direction of the openings, wherein said plurality of projected portions are disposed continuously in a plane of the first bonding portion and a plane of the second bonding portion, and wherein said projected portions of said first bonding portion and the said projected portions of said second bonding portion are disposed substantially in parallel to a rectilinear line connecting end portions where said unsealing member is supported, and each of the openings is located at an interval between adjacent ones of said projected portions.

32. A developer accommodating unit according to claim 25, wherein the openings are disposed along a direction crossing the unsealing direction of the openings.

33. A developer accommodating unit according to claim 25, wherein said projected portion and the openings are disposed on the same line with respect to the unsealing direction of the openings.

34. A developer accommodating unit according to claim 25, wherein said unsealing member is accommodated in said frame.

35. A developer accommodating unit according to claim 25, wherein said bonding portion does not exist in connecting portions of said flexible container between the openings.

36. A developer according to claim 25, wherein said unsealing member includes a sheet.

37. A developer according to claim 25, wherein said unsealing member is configured to be driven by a driving mechanism in an image forming apparatus.

38. An image forming apparatus comprising:

a developer container according to claim 25.

39. A developer accommodating unit according to claim 25, wherein said projected portion includes first and second projected portions which are provided in a same upstream or downstream side of the opening with respect to the unsealing direction, and said first projected portion connects to said second projected portion.

40. A developing device comprising:

a developer carrying member for carrying developer;

a frame provided with the developer carrying member and an opening for permitting discharge of accommodated developer;

a sealing member for sealing the opening and for exposing the opening by being moved; and an unsealing member, mounted to said sealing member inside of said frame, for moving said sealing member, wherein said developer carrying member and said unsealing member are provided as separate members, and wherein said frame includes a bonding portion for bonding said sealing member, and wherein said bonding portion includes a projected portion or a recessed portion (i) in a plane of said bonding portion and (ii) in an upstream side or a downstream side of the opening with respect to the unsealing direction of the opening.

41. A developer according to claim 40, wherein said unsealing member includes a sheet.

42. A developer according to claim 40, wherein said unsealing member is configured to be driven by a driving mechanism in an image forming apparatus.

43. A developing device according to claim 40, wherein an axis of the developer carrying member crosses the unsealing direction.

44. A developing device according to claim 40, wherein an axis of the developer carrying member is parallel to a longest line of the bonding portion.

45. A developer accommodating unit according to claim 40, wherein said projected portion includes first and second projected portions which are provided in a same upstream or downstream side of the opening with respect to the unsealing direction, and said first projected portion connects to said second projected portion.

* * * * *